US009701110B2

(12) United States Patent
Hishinuma et al.

(10) Patent No.: US 9,701,110 B2
(45) Date of Patent: Jul. 11, 2017

(54) LIQUID EJECTION HEAD PRODUCTION METHOD AND LIQUID EJECTION HEAD PRODUCTION SYSTEM

(71) Applicant: FUJIFILM Corporation, Tokyo (JP)

(72) Inventors: Yoshikazu Hishinuma, Ashigarakami-gun (JP); Tadashi Kyoso, Ashigarakami-gun (JP); Yasutoshi Hirabayashi, Ashigarakami-gun (JP); Satoshi Shimobayashi, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/224,050

(22) Filed: Jul. 29, 2016

(65) Prior Publication Data

US 2017/0028711 A1 Feb. 2, 2017

(30) Foreign Application Priority Data

Jul. 31, 2015 (JP) ..... 2015-152105

(51) Int. Cl.
*B41J 2/045* (2006.01)
*B41J 2/21* (2006.01)
*B41J 2/155* (2006.01)

(52) U.S. Cl.
CPC ..... *B41J 2/04536* (2013.01); *B41J 2/0456* (2013.01); *B41J 2/04586* (2013.01);
(Continued)

(58) Field of Classification Search
CPC B41J 2/040536; B41J 2/04586; B41J 2/0456; B41J 2/145; B41J 2/155;
(Continued)

(56) References Cited

U.S. PATENT DOCUMENTS 8,382,241 B2 * 2/2013 Saitoh ..... B41J 2/16526 347/16
8,646,869 B2 * 2/2014 Yamazaki ..... B41J 2/2135 347/19

(Continued)

FOREIGN PATENT DOCUMENTS

JP 2007-22092 A 2/2007
JP 2007-160834 A 6/2007
JP 2015-47833 A 3/2015

OTHER PUBLICATIONS

Extended European Search Report, dated Feb. 2, 2017, for European Application No. 16181852.1.

*Primary Examiner* — Anh T. N. Vo
(74) *Attorney, Agent, or Firm* — Birch, Stewart, Kolasch & Birch, LLP

(57) ABSTRACT

The production method for a liquid ejection head is provided, in which a first head module is set, a second candidate head module is selected, a first representative value of the first head module is acquired, a second representative value of the second candidate head module is acquired, an average value of the first representative value and the second representative value is derived, and the second candidate head module by which the derived average value is 0.76-fold or more and 1.24-fold or less of an average ejection volume target value is set as a second head module.

15 Claims, 29 Drawing Sheets

(52) U.S. Cl.
CPC ..... *B41J 2/155* (2013.01); *B41J 2202/11* (2013.01); *B41J 2202/19* (2013.01); *B41J 2202/20* (2013.01)

(58) Field of Classification Search
CPC .. B41J 2/2146; B41J 2002/11; B41J 2002/19; B41J 2002/20; B41J 2002/21
See application file for complete search history.

(56) References Cited

U.S. PATENT DOCUMENTS

| | | | | |
|---|---|---|---|---|
| 8,740,339 | B2 * | 6/2014 | Yamazaki | B41J 2/2139 347/13 |
| 8,882,219 | B2 * | 11/2014 | Sanada | B41J 19/20 347/10 |
| 2006/0188308 | A1 | 8/2006 | Tanaka et al. | |
| 2016/0167365 | A1 | 6/2016 | Hirabayashi | |

* cited by examiner

LIQUID EJECTION HEAD PRODUCTION METHOD AND LIQUID EJECTION HEAD PRODUCTION SYSTEM

CROSS-REFERENCE TO RELATED APPLICATIONS

The present application claims priority under 35 U.S.C. §119 to Japanese Patent Application No. 2015-152105, filed on Jul. 31, 2015. The above application is hereby expressly incorporated by reference, in its entirety, into the present application.

BACKGROUND OF THE INVENTION

Field of the Invention

The present invention relates to a liquid ejection head production method and a liquid ejection head production system, and particularly, relates to a production techniques of a liquid ejection head having a structure in which a plurality of head modules are arrayed in a single direction.

Description of the Related Art

There is known an ink-jet printing apparatus including a line-type ink-jet head having a structure in which a plurality of nozzles are provided over a length corresponding to the total width of a medium. As the line-type ink-jet head, a structure of arraying, in the width direction of the medium, a plurality of head modules in each of which a plurality of nozzle parts are arranged in a matrix can be employed.

Japanese Patent Application Laid-Open No. 2015-047833 describes a liquid ejection head configured to joint, in a single direction, a plurality of head modules in each of which a plurality of nozzle parts to eject liquid are arrayed. The liquid ejection head described in Japanese Patent Application Laid-Open No. 2015-047833 is configured to alternately joint a first head module in which the ejection volume of the liquid at one end part of the head module with respect to the array direction of the head module is greater than the ejection volume of the liquid at the other end part and a second head module in which the ejection volume of the liquid at the other end part is greater than the ejection volume of the liquid at one end part, and thereby, the density unevenness at joint parts of the head modules is suppressed.

Here, the terms "droplet", "ejection amount" and "recording head" described in Japanese Patent Application Laid-Open No. 2015-047833 correspond to the terms "liquid", "ejection volume" and "liquid ejection head" in the specification, respectively.

Japanese Patent Application Laid-Open No. 2007-022092 describes an ink-jet recording apparatus that generates image data such that a line graph showing density change characteristic depicts a line having a grade when the density change characteristic of an image to be drawn by the liquid ejection head is illustrated as the line graph, and that performs the drawing based on the generated image data.

The ink-jet printing apparatus described in Japanese Patent Application Laid-Open No. 2007-022092 performs such a control that the density changes continuously and gradually, allowing for the inconspicuousness of the image degradation due to the density unevenness by the liquid ejection head.

Here, the terms "printing head" and "ink-jet printer" described in Japanese Patent Application Laid-Open No. 2007-022092 correspond to the terms "liquid ejection head" and "ink-jet recording apparatus" in the specification, respectively.

Japanese Patent Application Laid-Open No. 2007-160834 describes a liquid ejection head in which a plurality of head modules are arranged along the array direction of nozzles. By arranging the head modules in order of the magnitude of average ejection volume or by equalizing the first head module and the N-th head module in average ejection volume, the liquid ejection head described in Japanese Patent Application Laid-Open No. 2007-160834 reduces the density unevenness caused by the difference in ejection volume among the head modules, and achieves the improvement in image quality.

Here, the terms "recording element substrate", "ejection amount" and "ink-jet recording head" in Japanese Patent Application Laid-Open No. 2007-160834 correspond to the terms "head module", "ejection volume" and "liquid ejection head" in the specification, respectively.

SUMMARY OF THE INVENTION

However, in the liquid ejection head described in Japanese Patent Application Laid-Open No. 2015-047833, in the case where the relative difference in ejection volume between the first head moudule and the second head module is large, it is difficult to suppress the appearance of the density unevenness at the joint part between the first head module and the second head module.

The ink-jet printing apparatus described in Japanese Patent Application Laid-Open No. 2007-022092, in the case where the difference in ejection volume between adjacently arranged head modules is large, fails to correct the image data, and it is difficult to suppress the appearance of the density unevenness.

In the liquid ejection head described in Japanese Patent Application Laid-Open No. 2007-160834, the variation in ejection volume within individual head modules is not considered, although the variation in average ejection volume between adjacently arranged head modules is considered. Hence, the difference in ejection volume between the mutually adjacent end parts of adjacently arranged head modules is sometimes large, and it is not possible to suppress the level difference in density at the joint part between the adjacently arranged head modules, resulting in a fear of the appearance of the density unevenness.

The present invention has been made in view of such a circumstance, and has an object to provide a liquid ejection head production method and a liquid ejection head production system that make it possible to suppress the deterioration in image quality at the joint part between head modules of the liquid ejection head having a structure in which a plurality of head modules are jointed in a single direction.

For achieving the above object, the following invention aspects are provided.

A liquid ejection head production method according to a first aspect is a production method for a liquid ejection head having a structure in which a plurality of head modules are arranged along a single direction, each of the plurality of head modules including a plurality of ejection elements, the liquid ejection head production method including: a first head module setting step of setting a first head module; a second candidate head module selection step of selecting a second candidate head module, the second candidate head module being a candidate for a second head module, the second head module being arranged at a position that is adjacent to the first head module; a first representative value acquisition step of acquiring a first representative value, the first representative value being a representative value of ejection volumes of ejection elements that are included in the first head module and that are arranged at a joint part between the first head module and the second head module; a second representative value acquisition step of acquiring a second representative value, the second representative value being a representative value of ejection volumes of ejection elements that are included in the second candidate head module and that are arranged at the joint part; an average value derivation step of deriving an average value of the first representative value and the second representative value; and a setting step of setting, as the second head module, the second candidate head module by which the average value derived in the average value derivation step is 0.76-fold or more and 1.24-fold or less of an average ejection volume target value, the average ejection volume target value being a previously decided target value of an average ejection volume in a whole of the head module.

According to the first aspect, the average value of the representative value of the ejection volumes of the first head module and the representative value of the ejection volumes of the second head module at the joint part between the first head module and the second head module that are arranged at adjacent positions falls within a previously decided range. Therefore, the difference in ejection volume at the joint part between the two head modules that are arranged at the adjacent positions is equalized, and the deterioration in ejection characteristic at the joint part is suppressed.

The ejection volume is the volume of a unit liquid that is ejected from the ejection element. The unit liquid is a liquid that forms one dot. As the mode in which the unit liquid is ejected, there is a mode in which all of the liquid that forms one dot is ejected by one ejection operation, or a mode in which all of the liquid that forms one dot is ejected by multiple ejection operations.

In the case where the second head module is arranged on both sides of the first head module, in the second candidate head module selection step, the second candidate head module is selected for each of the adjacent position on one side of the first head module and the adjacent position on the other side, as the second candidate head module.

A second aspect, in the liquid ejection head production method of the first aspect, can adopt a configuration in which an average value of the ejection volumes of the ejection elements that are included in the first head module and that are arranged at the joint part is acquired as the first representative value, in the first representative value acquisition step, and an average value of the ejection volumes of the ejection elements that are included in the second candidate head module and that are arranged at the joint part is acquired as the second representative value, in the second representative value acquisition step.

According to the second aspect, the average values are applied as the first representative value and the second representative value, and thereby, it is possible to derive the first representative value and the second representative value by a relatively simple process.

A third aspect, in the liquid ejection head production method of the first aspect, can adopt a configuration in which a median value of the ejection volumes of the ejection elements that are included in the first head module and that are arranged at the joint part is acquired as the first representative value, in the first representative value acquisition step, and a median value of the ejection volumes of the ejection elements that are included in the second candidate head module and that are arranged at the joint part is acquired as the second representative value, in the second representative value acquisition step.

According to the third aspect, the median values are as the first representative value and the second representative value, and thereby, it is possible to obtain the first representative value and second representative value that have resistance to noises caused by a measurement mistake or the like.

A fourth aspect, in the liquid ejection head production method of any one aspect of the first aspect to the third aspect, can adopt a configuration in which the first representative value that is derived using a measurement value is acquired in the first representative value acquisition step, the measurement value being obtained by measuring a liquid that is ejected by applying a liquid ejection duty, the liquid ejection duty being 80 percent or more of the maximum value of an ejection volume of a droplet that is used in liquid ejection.

According to the fourth aspect, the liquid ejection is performed by applying a high liquid ejection duty, and thereby, it is possible to obtain the first representative value based on the ejection volume distribution that reflects the ejection characteristic of the real head module.

A fifth aspect, in the liquid ejection head production method of any one aspect of the first aspect to the fourth aspect, can adopt a configuration in which the second representative value that is derived using a measurement value is acquired in the second representative value acquisition step, the measurement value being obtained by measuring a liquid that is ejected by applying a liquid ejection duty, the liquid ejection duty being 80 percent or more of the maximum value of an ejection volume of a droplet that is used in liquid ejection.

According to the fifth aspect, the liquid ejection is performed by applying a high liquid ejection duty, and thereby, it is possible to obtain the second representative value based on the ejection volume distribution that reflects the ejection characteristic of the real head module.

A sixth aspect, in the liquid ejection head production method of any one aspect of the first aspect to the fifth aspect, can adopt a configuration in which the first representative value that is derived using a measurement result is acquired in the first representative value acquisition step, the measurement result being obtained by measuring a liquid that is ejected by applying an ejection condition, the ejection condition being an ejection condition in which a liquid having the minimum volume is ejected.

According to the sixth aspect, the deterioration in ejection characteristic at the joint part is suppressed, even when the ejection condition for forming a dot having the minimum size is applied.

A seventh aspect, in the liquid ejection head production method of any one aspect of the first aspect to the sixth aspect, can adopt a configuration in which the second representative value that is derived using a measurement result is acquired in the second representative value acquisition step, the measurement result being obtained by measuring a liquid that is ejected by applying an ejection condition, the ejection condition being an ejection condition in which a liquid having the minimum volume is ejected.

According to the seventh aspect, the deterioration in ejection characteristic at the joint part is suppressed, even when the ejection condition for forming a dot having the minimum size is applied.

An eighth aspect, in the liquid ejection head production method of any one aspect of the first aspect to the seventh aspect, can be configured to further include: a first ejection volume distribution information acquisition step of acquiring information about ejection volume distribution of the first head module in a longitudinal direction of the liquid ejection head; and a first average value acquisition step of acquiring information about an average value of ejection volumes of all ejection elements of the first head module, in which the first representative value that is derived using the information about the ejection volume distribution of the first head module in the longitudinal direction of the liquid ejection head acquired in the first ejection volume distribution information acquisition step and the information about the average value of the ejection volumes of all ejection elements of the first head module acquired in the first average value acquisition step is acquired in the first representative value acquisition step.

According to the eighth aspect, it is possible to acquire the first representative value that is derived using the information about the ejection volume distribution of the first head module in the longitudinal direction of the liquid ejection head and the information about the average value of the ejection volumes of all ejection elements of the first head module acquired in the first average value acquisition step.

A ninth aspect, in the liquid ejection head production method of any one aspect of the first aspect to the eighth aspect, can be configured to further include: a second ejection volume distribution information acquisition step of acquiring information about ejection volume distribution of the second candidate head module in a longitudinal direction of the liquid ejection head; and a second average value acquisition step of acquiring information about an average value of ejection volumes of all ejection elements of the second candidate head module, in which the second representative value that is derived using the information about the ejection volume distribution of the second candidate head module in the longitudinal direction of the liquid ejection head acquired in the second ejection volume distribution information acquisition step and the information about the average value of the ejection volumes of all ejection elements of the second candidate head module acquired in the second average value acquisition step is acquired in the second representative value acquisition step.

According to the ninth aspect, it is possible to acquire the second representative value that is derived using the information about the ejection volume distribution of the second candidate head module in the longitudinal direction of the liquid ejection head and the information about the average value of the ejection volumes of all ejection elements of the second candidate head module acquired in the second average value acquisition step.

A tenth aspect, in the liquid ejection head production method of any one aspect of the first aspect to the ninth aspect, can be configured to further include an average ejection volume target value setting step of setting the average ejection volume target value.

In the tenth aspect, the average ejection volume target value may be automatically set depending on the specification of the liquid ejection head, or may be manually set.

An eleventh aspect, in the liquid ejection head production method of any one aspect of the first aspect to the tenth aspect, can adopt a configuration in which a head module in which the average ejection volume in the whole of the head module is adjusted to a previously decided value is selected as the second candidate head module, in the second candidate head module selection step.

According to the eleventh aspect, it is possible to select a head module in which the average ejection volume in the whole of the head module is adjusted to a previously decided value, as the second candidate head module.

A twelfth aspect, in the liquid ejection head production method of the tenth aspect, can adopt a configuration in which a head module in which the average ejection volume in the whole of the head module is adjusted to the average ejection volume target value is selected as the second candidate head module, in the second candidate head module selection step.

According to the twelfth aspect, it is possible to adopt a configuration in which the head module after the adjustment to the average ejection volume target value of the liquid ejection head is selected as the second candidate head module.

A thirteenth aspect, in the liquid ejection head production method of any one aspect of the first aspect to the twelfth aspect, can be configured to further include a first candidate head module selection step of selecting a first candidate head module, the first candidate head module being a candidate for the first head module, in which the first candidate head module is set as the first head module, in the first head module setting step.

According to the thirteenth aspect, it is possible to adopt an arbitrary head module, as the head module that is set first.

A fourteenth aspect, in the liquid ejection head production method of any one aspect of the first aspect to the thirteenth aspect, can be configured to further include a second representative value storage step of storing the second representative value, in which, in a case where the second representative value stored in the second representative value storage step is present, the stored second representative value is read as the first representative value, in the first representative value acquisition step.

According to the fourteenth aspect, when the plurality of head modules are sequentially set in the arrangement order of the head modules, it is possible to use, as the first representative value, the information stored as the second representative value of the last head module.

A liquid ejection head production system according to a fifteenth aspect is a production system for a liquid ejection head having a structure in which a plurality of head modules are arranged along a single direction, each of the plurality of head modules including a plurality of ejection elements, the liquid ejection head production system comprising: a first head module setting unit that sets a first head module; a second candidate head module selection unit that selects a second candidate head module, the second candidate head module being a candidate for a second head module, the second head module being arranged at a position that is adjacent to the first head module; a first representative value acquisition unit that acquires a first representative value, the first representative value being a representative value of ejection volumes of ejection elements that are included in the first head module or are included in a first candidate head module and that are arranged at a joint part between the first head module and the second head module, the first candidate head module being a candidate for the first head module; a second representative value acquisition unit that acquires a second representative value, the second representative value being a representative value of ejection volumes of ejection elements that are included in the second candidate head module and that are arranged at the joint part; an average value derivation unit that derives an average value of the first representative value and the second representative value; and a second head module setting unit that sets, as the second head module, the second candidate head module by which the average value derived by the average value derivation unit is 0.76-fold or more and 1.24-fold or less of an average ejection volume target value, the average ejection volume target value being a previously decided target value of an average ejection volume in a whole of the head module.

According to the fifteenth aspect, it is possible to obtain the same effect as the first aspect.

In the fifteenth aspect, the same matters as the matters specified in the second aspect to the fourteenth aspect can be combined when appropriate. In that case, the steps or processes specified in the liquid ejection head production method can be understood as elements of devices that serve the corresponding processes or functions.

According to the present invention, the average value of the representative value of the ejection volumes of the first head module and the representative value of the ejection volumes of the second head module at the joint part between the first head module and the second head module that are arranged at adjacent positions falls within a previously decided range, and therefore, the difference in ejection volume at the joint part between the two head modules that are arranged at the adjacent positions is equalized, and the deterioration in ejection characteristic at the joint part is suppressed.

DETAILED DESCRIPTION OF THE EMBODIMENTS

Hereinafter, preferable embodiments of the present invention are described in detail with reference to the accompanying drawings.

[Structure of Ink-Jet Head]

<Overall Configuration>

Figure 1:
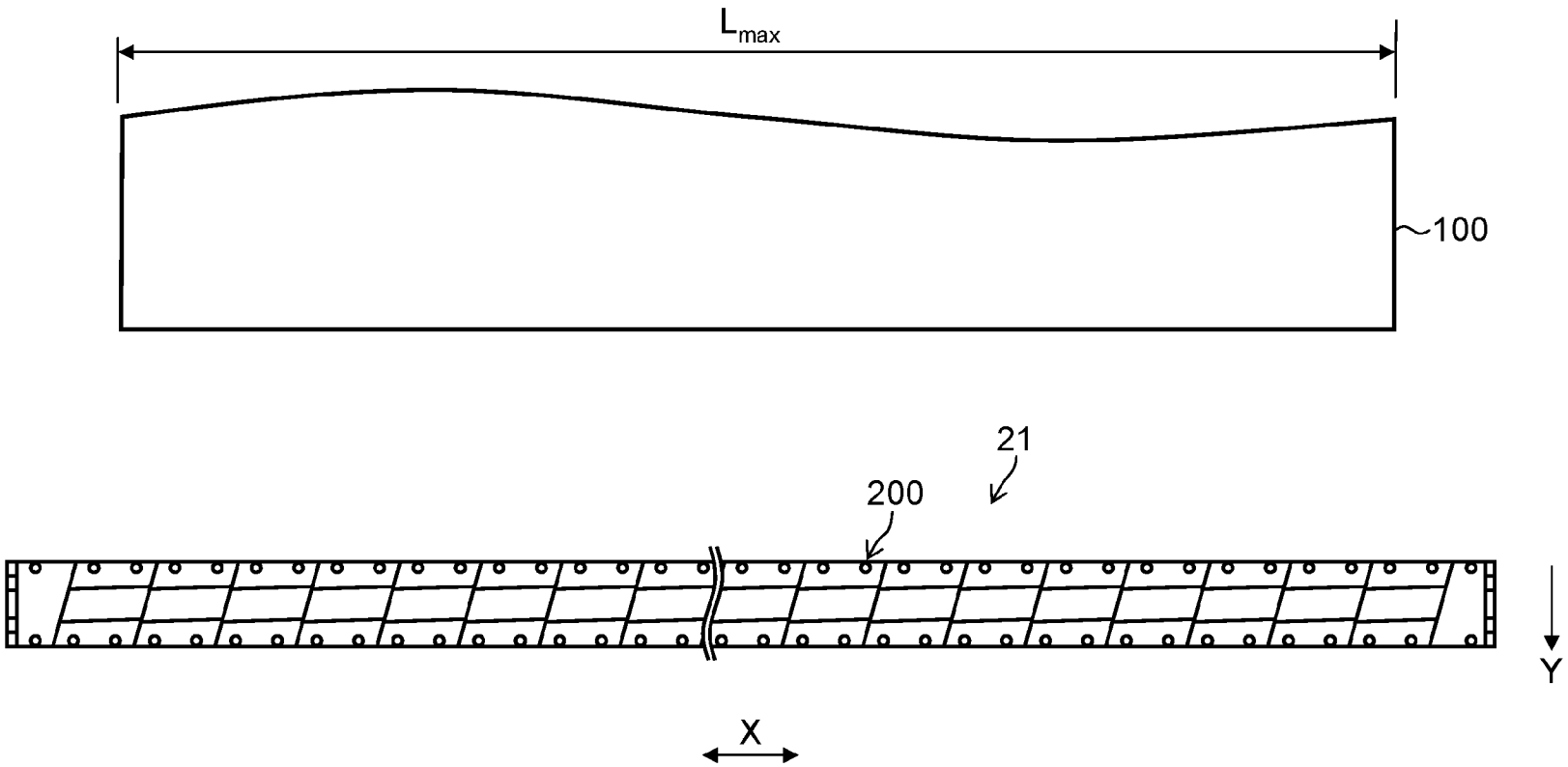
FIG. 1 is a perspective plan view illustrating a structure example of an ink-jet head.

FIG. 1 is a perspective plan view illustrating a structure example of an ink-jet head. An ink-jet head 21 illustrated in FIG. 1 has a structure in which a plurality of head modules 200 are jointed in the width direction of a medium 100 that is the direction orthogonal to the feed direction of the medium 100. The ink-jet head in the specification is a mode of the liquid ejection head.

The structure in which the plurality of head modules 200 are jointed in the width direction of the medium 100 in the embodiment is a mode of the structure in which a plurality of head modules are arranged along a single direction.

The term "orthogonal" in the specification includes the case of being substantially orthogonal that is of the case of a cross at an angle exceeding 90 degrees or the case of a cross at an angle less than 90 degrees and that exhibits a function effect identical to the case of a cross at an angle of 90 degrees.

Further, the term "parallel" in the specification includes the case of being substantially parallel that exhibits a function effect identical to the case of being parallel, although two directions cross. Furthermore, the term "identical" in the specification includes the case of being substantially identical that makes it possible to obtain a similar function effect to the case of being identical, although there a difference in the configuration of the object.

In the specification, the width direction of the medium 100 is sometime described as the X-direction. Further, the feed direction of the medium 100 is sometimes described as the Y-direction or the medium feed direction. These terms can be replaced with each other when appropriate.

Figure 4:
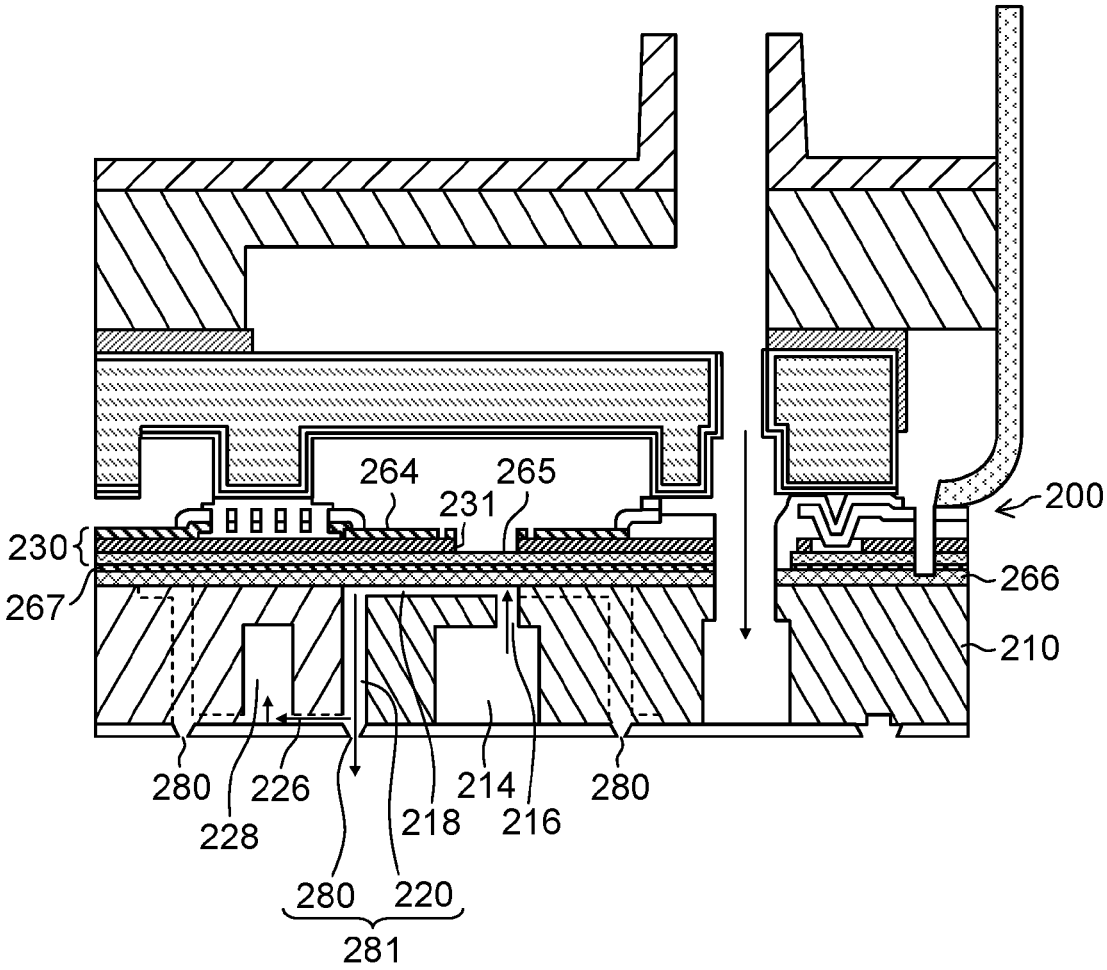
FIG. 4 is a cross-section view illustrating an internal structure of the head module.

The ink-jet head 21 illustrated in FIG. 1 is a line-type ink-jet head in which a plurality of nozzle parts are arranged over a length equal to or greater than the total length $L_{max}$ of the medium 100 in the width direction of the medium 100. The nozzle part, which is not illustrated in FIG. 1, is illustrated in FIG. 4 while reference numeral 281 is assigned.

An identical structure can be applied to the plurality of head modules 200 constituting the ink-jet head 21. Further, the head module 200 can function alone, as the ink-jet head.

<Structure of Head Module>

Figure 2:
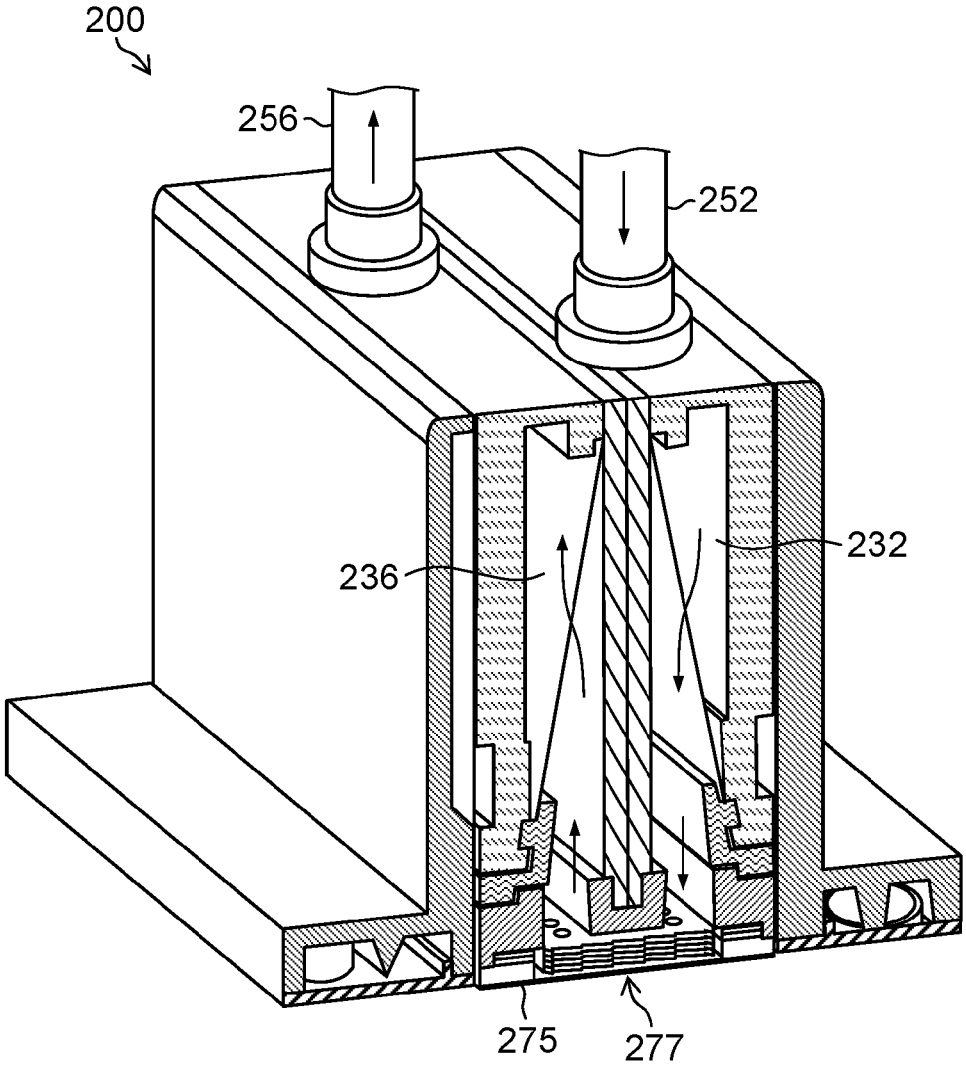
FIG. 2 is a perspective view of a head module, and is a diagram including a partial cross-section view.

FIG. 2 is a perspective view of a head module, and is a diagram including a partial cross-section view. Hereinafter, identical reference numerals are assigned to constituents identical to constituents that are previously described, and the descriptions are omitted when appropriate.

Ink in the specification is a mode of the liquid, and the term "ink" and the term "liquid" can be replaced when appropriate. Further, in the specification, the term "discharge" and the term "ejection" can be treated as synonymous terms, and the term "discharge" and the term "ejection" can be replaced when appropriate.

The head module 200 has an ink supply unit including an ink supply chamber 232, an ink circulation chamber 236 and the like, on the upper side in FIG. 2, which is the opposite side to a liquid ejection surface 277 of a nozzle plate 275.

The ink supply chamber 232 is connected with an ink tank not illustrated, through a supply-side individual passage 252, and the ink circulation chamber 236 is connected with a collection tank not illustrated, through a collection-side individual passage 256.

Figure 3:
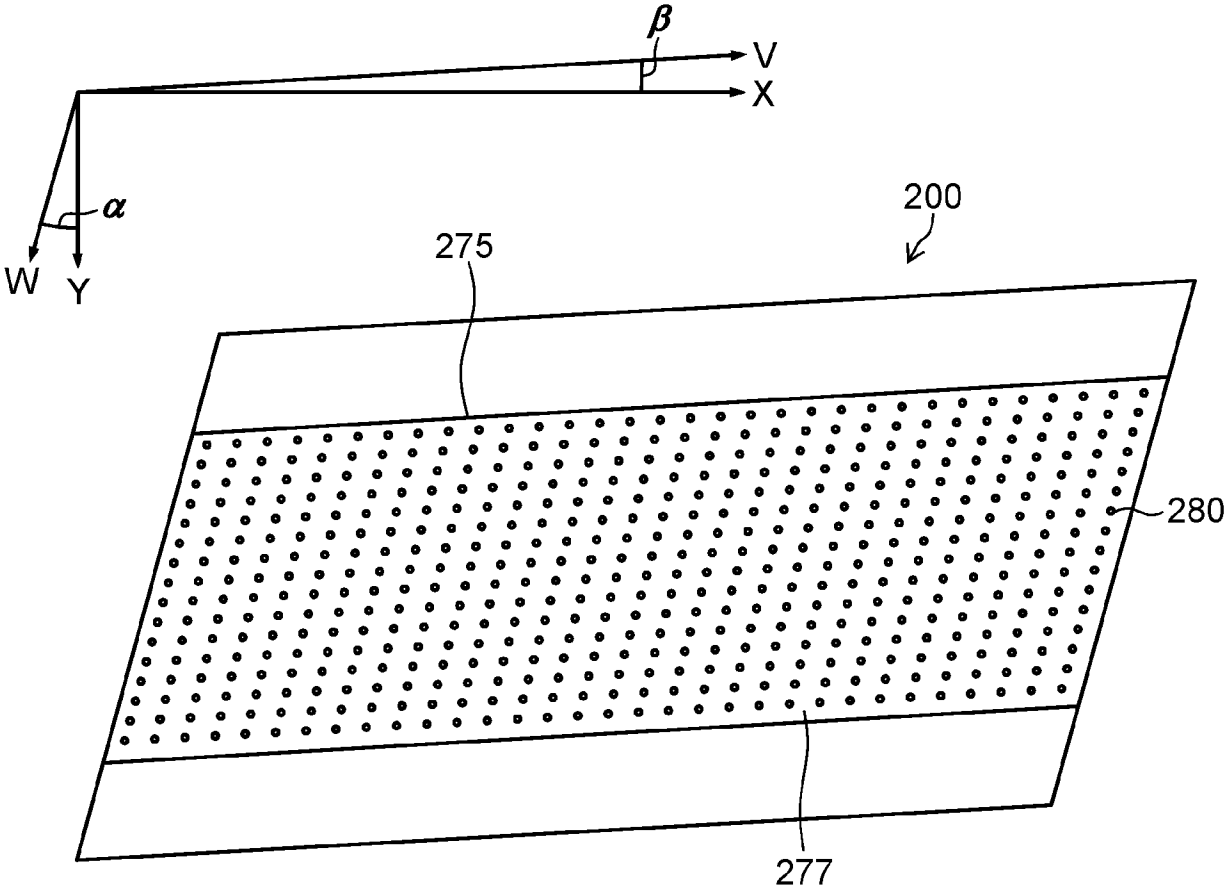
FIG. 3 is a perspective plan view of a liquid ejection surface of the head module.

FIG. 3 is a perspective plan view of the liquid ejection surface of the head module. In FIG. 3, nozzle openings 280 to be arranged on the liquid ejection surface 277 are illustrated so as to be reduced in number, but on the liquid ejection surface 277 of one head module 200, a plurality of nozzle openings 280 are arranged by a two-dimensional arrangement.

The head module 200 has a planar shape of a parallelogram that includes a long-side edge surface along a V-direction having a slope of an angle $\beta$ with respect to the direction orthogonal to the medium feed direction and a short-side edge surface along a W-direction having a slope of an angle $\alpha$ with respect to the medium feed direction, and the plurality of nozzle openings 280 are arranged in a matrix, in a row direction along the V-direction and in a column direction along the W-direction.

The arrangement of the nozzle openings 280 is not limited to the mode illustrated in FIG. 3, and the plurality of nozzle openings 280 may be arranged in a row direction along the direction orthogonal to the medium feed direction and in a column direction crossing obliquely with respect to the direction orthogonal to the medium feed direction.

The matrix arrangement of the nozzle openings 280 is an arrangement of the nozzle openings 280 in which the arrangement intervals of the nozzle openings 280 are uniform on a projected nozzle array in the direction orthogonal to the medium feed direction, which is an array resulting from projecting the plurality of nozzle openings 280 in the direction orthogonal to the medium feed direction and arranging the plurality of nozzle openings 280 along the direction orthogonal to the medium feed direction.

FIG. 4 is a cross-section view illustrating an internal structure of the ink-jet head. Reference numeral 214 designates an ink supply path, reference numeral 218 designates a pressure chamber, reference numeral 216 designates an individual supply path that connects each pressure chamber 218 and the ink supply path 214, reference numeral 220 designates a nozzle communication path that is connected from the pressure chamber 218 to the nozzle opening 280, and reference numeral 226 designates a circulation individual passage that connects the nozzle communication path 220 and a circulation common passage 228. The pressure chamber 218 is sometimes referred to as a liquid chamber.

A vibration plate 266 is provided on a passage structure body 210 that configures the ink supply path 214, the individual supply path 216, the pressure chamber 218, the nozzle communication path 220, the circulation individual passage 226 and the circulation common passage 228. A piezoelectric element 230 having a laminate structure of a lower electrode 265, a piezoelectric substance layer 231 and an upper electrode 264 is provided on the vibration plate 266, through an adhesion layer 267. The lower electrode 265 is sometimes referred to as a common electrode, and the upper electrode 264 is sometimes referred to as an individual electrode.

The upper electrode 264 is an individual electrode that is patterned so as to correspond to the shape of each pressure chamber 218, and the piezoelectric element 230 is provided for each pressure chamber 218.

The ink supply path 214 is connected with the ink supply chamber 232 illustrated in FIG. 2, and the link is supplied from the ink supply path 214 through the individual supply path 216 to the pressure chamber 218. Depending on input image data, a drive voltage is applied to the upper electrode 264 of the piezoelectric element 230 provided on the corresponding pressure chamber 218. Thereby, the piezoelectric element 230 and the vibration plate 266 are transformed, and the volume of the pressure chamber 218 is changed. By a pressure change associated with this, the ink is discharged from the nozzle opening 280 through the nozzle communication path 220.

It is possible to discharge the ink from the nozzle opening 280, by controlling the drive of the piezoelectric element 230 corresponding to each nozzle opening 280, depending on dot arrangement data that is generated from the input image data.

While the medium 100 is fed at a constant speed in the medium feed direction, the timing of the ink discharge from each nozzle opening 280 is controlled in concert with the feed speed, and thereby, it is possible to record a desired image on the medium 100.

In the pressure chamber 218 provided so as to correspond to each nozzle opening 280, the planar shape is a roughly square shape. At one of both corner parts on a diagonal line, an outlet to the nozzle opening 280 is provided, and at the other, the individual supply path 216, which is an inlet of the supply ink, is provided. The illustration of the planar shape of the pressure chamber 218 is omitted.

Here, the planar shape of the pressure chamber is not limited to a square shape. As the planar shape of the pressure chamber, various shapes, as exemplified by a polygon such as a tetragon including a rhombus and a rectangle, a pentagon and a hexagon, a circle and an ellipse, are possible.

In the nozzle part 281 including the nozzle opening 280 and the nozzle communication path 220, a circulation outlet is formed, and the nozzle part 281 is communicated with the circulation individual passage 226 through the circulation outlet. The ink that is of the ink in the nozzle communication path 220 and the nozzle opening 280 and that is not used for discharge is collected to the circulation common passage 228 through the circulation individual passage 226.

The circulation common passage 228 is connected with the ink circulation chamber 236 illustrated in FIG. 2, and at all times, the ink is collected to the circulation common passage 228 through the circulation individual passage 226, resulting in the prevention of the thickening of the ink near the nozzle opening 280 when the discharge is not performed.

As a mode of the ejection element included in the head module, there is a mode of including one nozzle part 281, a passage such as the pressure chamber 218 communicated with the one nozzle part 281, and the piezoelectric element 230 corresponding to the nozzle part 281.

Hereinafter, the term "nozzle opening" and the term "nozzle part" in the specification can be replaced with "ejection element", when appropriate. Further, the term "nozzle opening" can be replaced with the term "nozzle part", when appropriate.

Examples of the piezoelectric element 230 include a piezoelectric element 230 having a structure of being individually separated so as to correspond to the nozzle opening 280 illustrated in FIG. 3. Needless to say, it is allowable to apply a structure in which the piezoelectric substance layer 231 is integrally formed for the plurality of nozzle parts 281, the individual electrode is formed so as to correspond to each nozzle part 281 and an active region is formed for each nozzle part 281.

It is allowable to apply a thermal system in which a heater is included within the pressure chamber 218 as a pressure generation element instead of the piezoelectric element, a drive voltage is supplied to the heater for heat generation and the ink in the pressure chamber 218 is discharged from the nozzle opening 280 by utilizing the film boiling phenomenon.

<Support Structure for Head Module>

Figure 5:
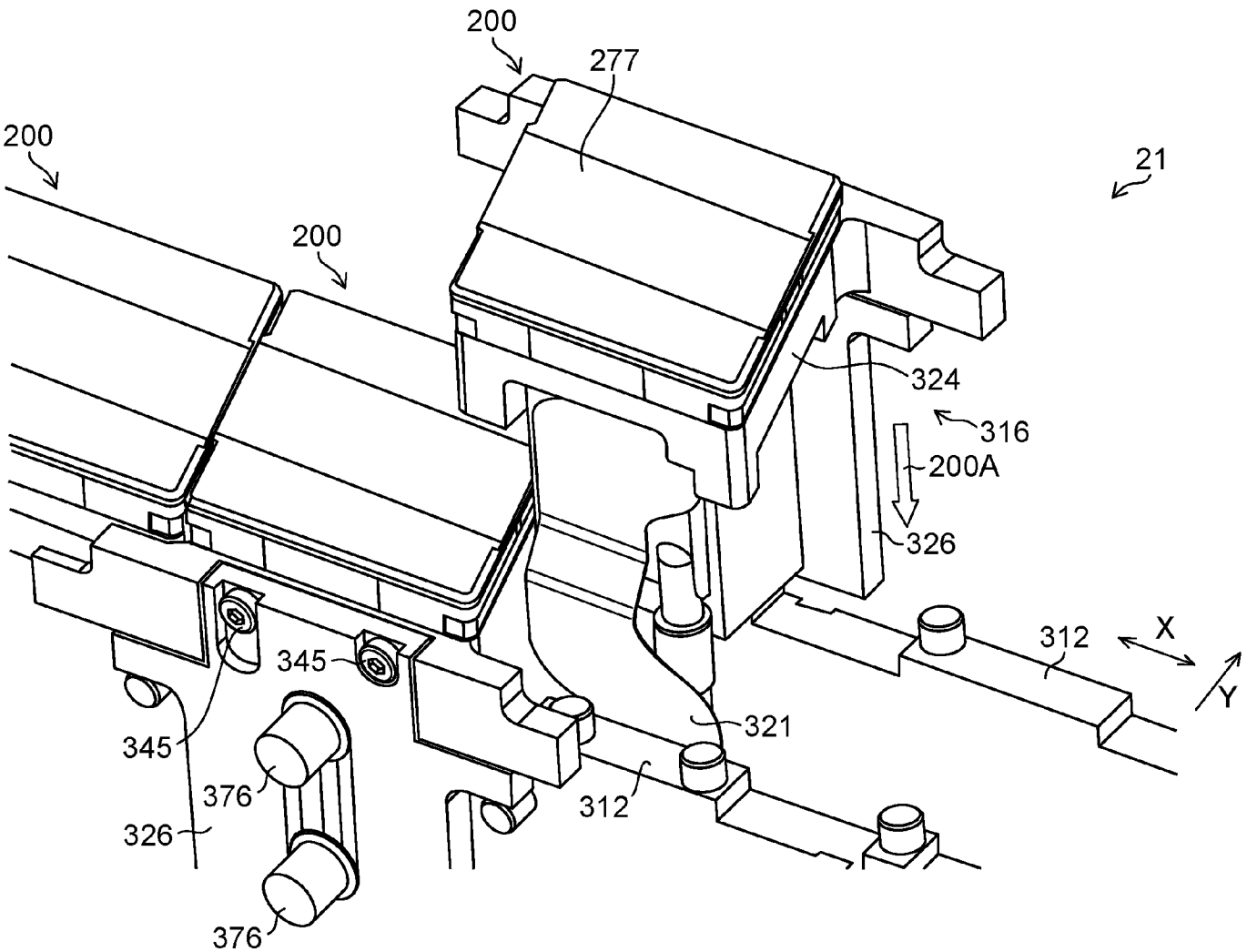
FIG. 5 is a perspective view illustrating a support structure for the head module.

FIG. 5 is a perspective view illustrating a support structure for the head module. FIG. 5 is a partial enlarged view of the ink-jet head 21, and is a diagram when the head module 200 is viewed from the side of the liquid ejection surface 277.

In FIG. 5, the direction illustrated while reference character X is assigned is the longitudinal direction of the ink-jet head 21. The longitudinal direction of the ink-jet head 21 is the width direction of the medium in a state in which the ink-jet head 21 is used while the ink-jet head 21 illustrated in FIG. 1 is mounted on the ink-jet recording apparatus.

Further, in FIG. 5, the direction illustrated while reference character Y is assigned is the short direction of the ink-jet head 21. The short direction of the ink-jet head 21 is the feed direction of the medium in a state in which the ink-jet head 21 is used while the ink-jet head 21 illustrated in FIG. 1 is mounted on the ink-jet recording apparatus.

In the specification, the "longitudinal direction of the ink-jet head 21" and the "width direction of the medium" can be replaced with each other. Similarly, the "short direction of the ink-jet head 21" and the "feed direction of the medium" can be replaced with each other.

Hereinafter, the longitudinal direction of the ink-jet head 21 is sometimes described as the X-direction. The short direction of the ink-jet head is sometimes described as the Y-direction.

FIG. 5 illustrates a state in which one of the plurality of head modules 200 attached to base frames 312 has been detached from the base frames 312. The arrow to which reference character 200A is assigned in FIG. 5 illustrates the attaching direction of the head module 200 to the base frames 312.

As illustrated in FIG. 5, the head module 200 is attached to a bracket 316. The bracket 316 includes a head module support part 324 that supports the head module 200, and a base frame support part 326 that is joined to one edge of the head module support part 324. The head module support part 324 is attached to the base frame support part 326, using two screws 345.

On the bracket 316, an X-direction adjustment part and a Y-direction adjustment part, which are not illustrated, are provided. The X-direction adjustment part has a structure for adjusting the relative position in the X-direction between an arbitrary head module 200 and a different head module 200 arranged at a position adjacent to the arbitrary head module 200.

The Y-direction adjustment part has a structure for adjusting the relative position in the Y-direction between an arbitrary head module 200 and a different head module 200 arranged at a position adjacent to the arbitrary head module 200.

As illustrated in FIG. 5, the head modules 200 attached to the base frames 312 include head modules 200 in each of which the base frame support part 326 is attached to one side of the head module 200 in the Y-direction and head modules 200 in each of which the base frame support part 326 is attached to the other side of the head module 200 in the Y-direction.

The ink-jet head 21 has a structure of alternately arranging the head modules 200 in each of which the base frame support part 326 is attached to one side of the head module 200 in the Y-direction and the head modules 200 in each of which the base frame support part 326 is attached to the other side of the head module 200 in the Y-direction.

A guide post 376 functions as a device that fixes the head module 200 attached to the bracket 316, on the base frames 312, and functions as a device that urges the head module 200 attached to the bracket 316, in the Y-direction.

A flexible substrate 321 to be connected with an electric wire of the head module 200 passes through the interval between the two facing base frames 312, and is connected with a drive circuit substrate on the opposite side to the liquid ejection surface 277 of the head module 200. The illustration of the drive circuit substrate is omitted.

The support structure for the head module 200 in the ink-jet head 21 illustrated in FIG. 5 is an example, and another support structure may be applied.

<Description of Joint Part>

Figure 6:
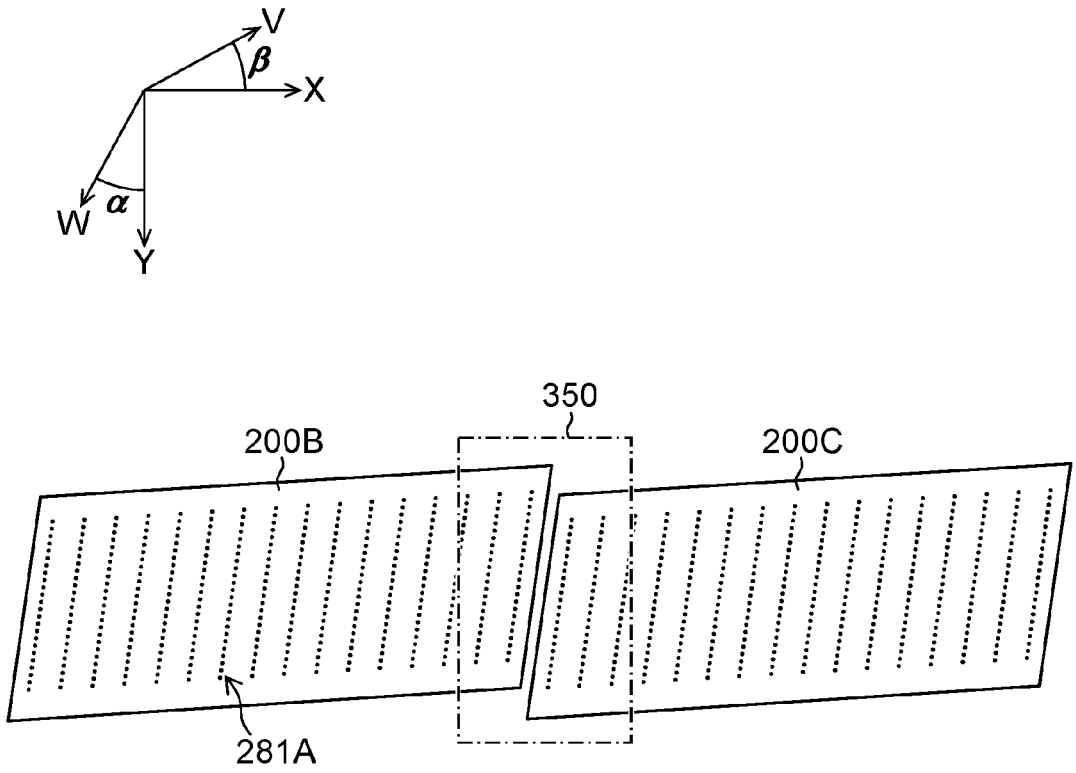
FIG. 6 is a conceptual diagram of a joint part.
Figure 7:
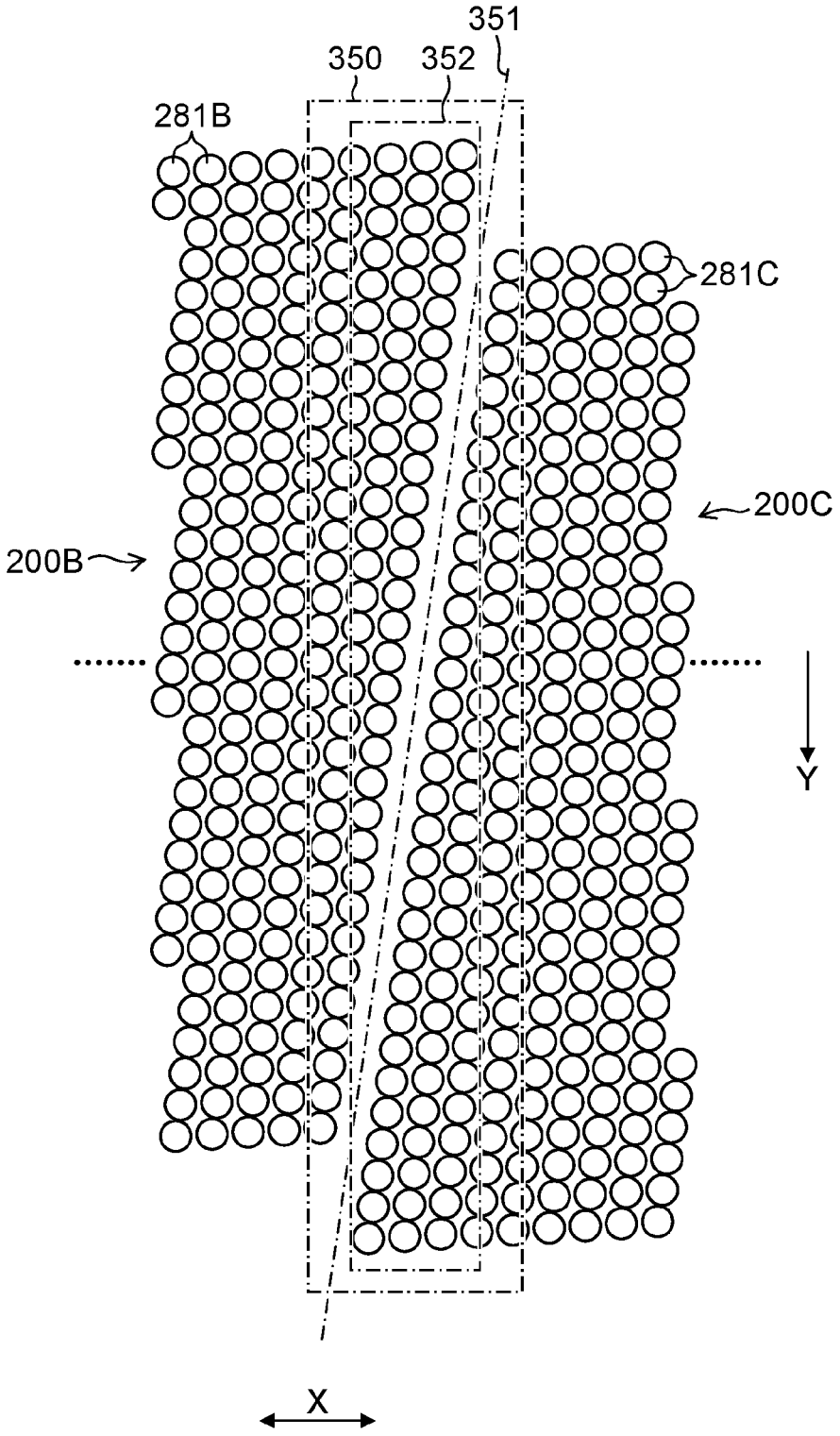
FIG. 7 is a partial enlarged view of FIG. 6.

FIG. 6 is a conceptual diagram of a joint part. FIG. 7 is a partial enlarged view of FIG. 6. FIG. 6 and FIG. 7 are perspective plan views of the liquid ejection surface 277, similarly to FIG. 3. FIG. 6 does not illustrate the nozzle parts 281 illustrated in FIG. 4 individually, and schematically illustrates, by dotted lines, nozzle arrays 281A each of which is constituted by a plurality of nozzle parts along the column direction illustrated in FIG. 3 while reference character W is assigned.

FIG. 6 and FIG. 7 illustrate only two head modules of the plurality of head modules 200 illustrated in FIG. 1. In the two head modules illustrated in FIG. 6 and FIG. 7, the head module on the left side in FIG. 6 is referred to as a first head module 200B, and the head module on the right side in FIG. 6 is referred to as a second head module 200C.

In FIG. 7, reference character 281B designates a nozzle part belonging to the first head module 200B. Reference character 281C designates a nozzle part belonging to the second head module 200C.

The first head module 200B and second head module 200C illustrated in FIG. 6 can be configured as follows.

The number of the nozzle parts that constitute a single nozzle array along the W-direction is 32, the number of the nozzle arrays along the V-direction is 64, and the print resolution in the X-direction is 1200 dots per inch. The numerical value showing the print resolution shows the number of nozzle parts per 1 inch.

Here, 1 inch is 25.4 millimeters. The print resolution illustrated as the number of dots per 1 inch can be converted into the number of dots per 1 millimeter, by being divided by 25.4.

The inverse number of the number of dots per 1 millimeter is the inter-dot pitch. That is, when a print resolution of 1200 dots per inch is converted into inter-dot pitch, the value rounded to the first decimal place is 21.2 micrometers.

As a configuration example of a joint part 350 illustrated in FIG. 6 and FIG. 7, there is a mode in which 128 nozzle parts are included and the length in the X-direction is 2.5 millimeters.

In FIG. 6 and FIG. 7, the region surrounded by a dashed line is the joint part 350. The joint part 350 is a part that contains a position of the mechanical connection between the first head module 200B and the second head module 200C and that has a previously decided X-directional length.

In FIG. 6, the illustration of the position of the mechanical connection between the first head module 200B and the second head module is omitted. The position of the mechanical connection between the first head module 200B and the second head module 200C is illustrated by a dashed line in FIG. 7, while reference numeral 351 is assigned.

At the joint part 350 illustrated in FIG. 7, there is a nozzle combining region 352. The nozzle combining region 352 is a region where the print resolution of the ink-jet head 21 is actualized while nozzle parts 281 B belonging to the first head module 200B and nozzle parts 281C belonging to the second head module 200C are combined.

Here, in the case where the nozzle parts are arranged in a matrix, the shape of the joint part 350 illustrated in FIG. 6 and FIG. 7 is complex, and therefore, the joint part 350 illustrated in FIG. 6 and FIG. 7 is simplified to the extent that the concept of the joint part 350 can be understood. Similarly, the nozzle combining region 352 illustrated in FIG. 7 is also simplified to the extent that the concept of the nozzle combining region 352 can be understood.

Figure 8:
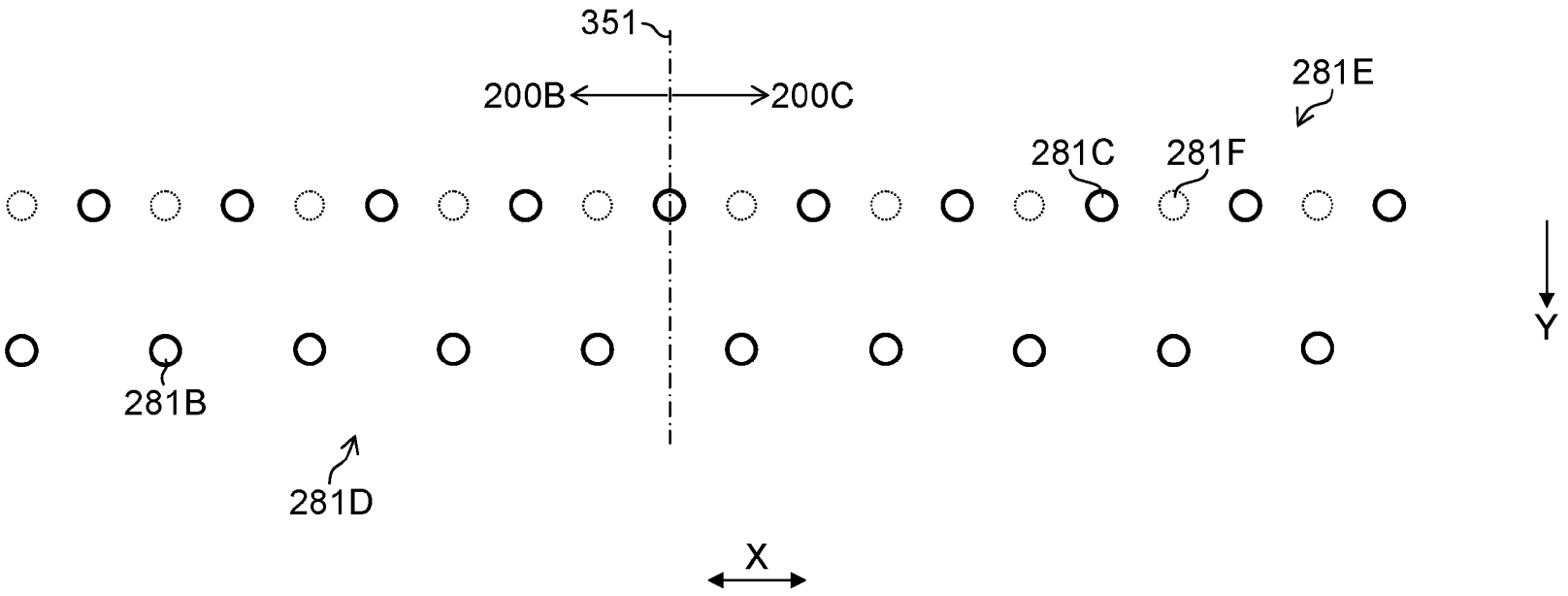
FIG. 8 is an explanatory diagram schematically illustrating an arrangement of nozzle parts at a nozzle combining region.

FIG. 8 is an explanatory diagram schematically illustrating an arrangement of nozzle parts at the nozzle combining region. A projected nozzle array 281D illustrated on the lower row in FIG. 8 includes nozzle parts 281B belonging to the first head module 200B illustrated in FIG. 6 and FIG. 7, and has an arrangement of the nozzle parts 281B that results from projecting the nozzle parts 281B arranged at the nozzle combining region 352 in the X-direction and arranging them along the X-direction.

Further, a projected nozzle array 281E illustrated on the upper row in FIG. 8 includes nozzle parts 281C belonging to the second head module 200C illustrated in FIG. 6 and FIG. 7, and has an arrangement of the nozzle parts 281C that results from projecting the nozzle parts 281C arranged at the nozzle combining region 352 in the X-direction and arranging them along the X-direction.

In the case where there is no error in the relative position between the first head module 200B and second head module 200C illustrated in FIG. 6 and FIG. 7 and where the first head module 200B and the second head module 200C are arranged at the theoretical positions, the X-directional positions of the nozzle parts 281B belonging to the projected nozzle array 281D, as illustrated in FIG. 8, coincide with the X-directional position of the nozzle parts 281C belonging to the projected nozzle array 281E, at the nozzle combining region 352 illustrated in FIG. 7.

Nozzle parts 281F illustrated in FIG. 8 by using the dotted lines are the nozzle parts belonging to the projected nozzle array 281D in the case where there is no error in the relative position between the first head module 200B and the second head module 200C and where the first head module 200B and the second head module 200C are arranged.

Meanwhile, there is an error in position between the first head module 200B and the second head module 200C, and therefore, there is a deviation between the X-directional positions of the nozzle parts 281B belonging to the projected nozzle array 281D and the X-directional positions of the nozzle parts 281C belonging to the projected nozzle array 281E.

FIG. 8 illustrates the nozzle parts 281C belonging to the projected nozzle array 281E in the case where the error in the relative position between the first head module 200B and second head module 200C illustrated in FIG. 6 and FIG. 7 is maximized.

Therefore, by performing the printing while appropriately selecting the nozzle parts 281B belonging to the first head module 200B and the nozzle parts 281C belonging to the second head module 200C at the joint part 350, the resolution of the ink-jet head 21 is actualized at the joint part 350 also.

Figure 9:
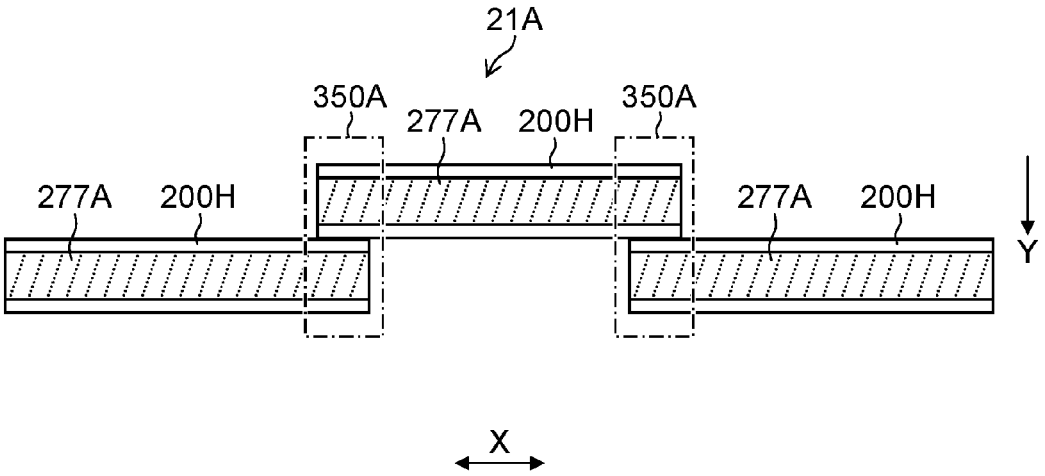
FIG. 9 is an explanatory diagram illustrating an alternative example of the joint part.
Figure 10:
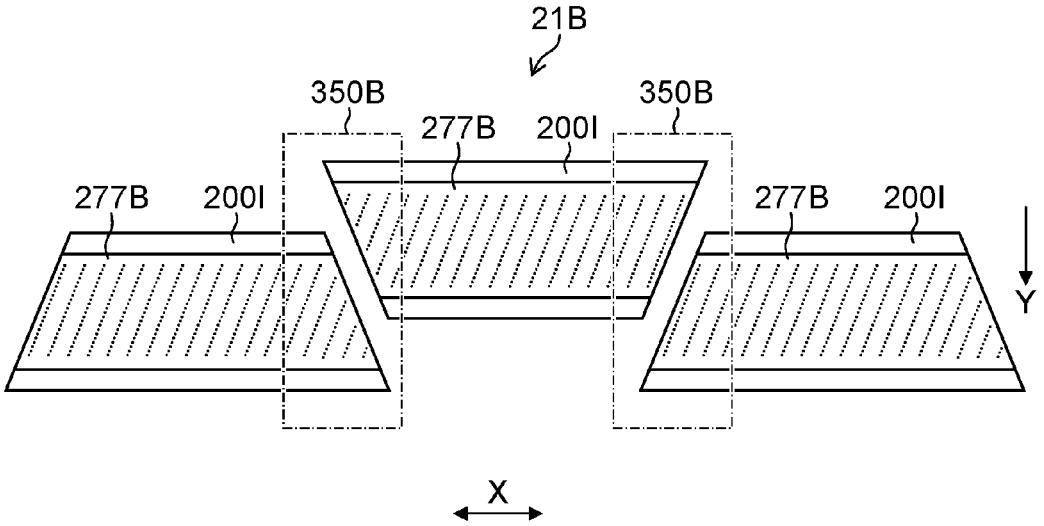
FIG. 10 is a perspective plan view of a liquid ejection surface that illustrates a further alternative example of the joint part.

FIG. 9 is a perspective plan view of a liquid ejection surface illustrating an alternative example of the joint part. FIG. 10 is a perspective plan view of a liquid ejection surface illustrating a further alternative example of the joint part.

In an ink-jet head 21A illustrated in FIG. 9, the planar shape of a surface containing a liquid ejection surface 277A of a head module 200H and the planar shape of the liquid ejection surface 277A are rectangles. The ink-jet head 21A illustrated in FIG. 9 is arranged such that the positions of the head modules 200H in the Y-direction are deviated alternately.

When the leftmost head module 200H of the three head modules 200H illustrated in FIG. 9 is the first head module 200B illustrated in FIG. 6 and FIG. 7, the central head module 200H in FIG. 9 is the second head module 200C illustrated in FIG. 6 and FIG. 7.

Further, when the central head module 200H in FIG. 9 is the first head module 200B illustrated in FIG. 6 and FIG. 7, the rightmost head module 200H in FIG. 9 is the second head module 200C illustrated in FIG. 6 and FIG. 7.

At joint parts 350A of the ink-jet head 21A illustrated in FIG. 9, there are nozzle combining regions.

In an ink-jet head 21B illustrated in FIG. 10, the planar shape of a surface containing a liquid ejection surface 277B of a head module 200I and the planar shape of the liquid ejection surface 277B are trapezoids. The ink-jet head 21B illustrated in FIG. 10 is arranged such that the short sides and long sides of the surfaces containing the liquid ejection surfaces 277B of the head modules 200H are transposed alternately.

The correspondence relation between the three head modules 200I illustrated in FIG. 10 and the first head module 200B and second head module 200C illustrated in FIG. 6 and FIG. 7 is identical to the correspondence relation between the three head modules 200H illustrated in FIG. 9 and the first head module 200B and second head module 200C illustrated in FIG. 6 and FIG. 7, and the description is omitted here.

Further, at joint parts 350B of the ink-jet head 21B illustrated in FIG. 10, there are nozzle combining regions.

Figure 11:
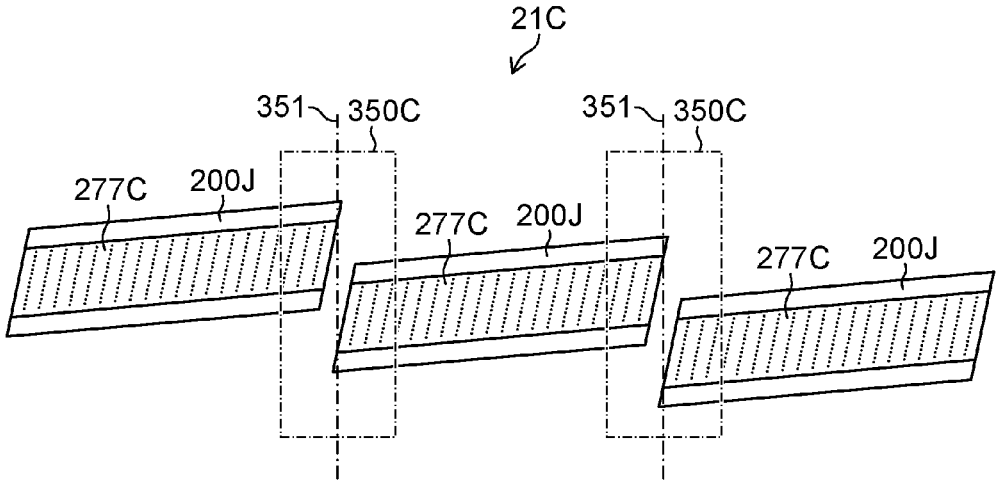
FIG. 11 is a perspective plan view of a liquid ejection surface that illustrates a further alternative example of the joint part.

FIG. 11 is a perspective plan view of a liquid ejection surface illustrating a further alternative example of the joint part. An ink-jet head 21C illustrated in FIG. 11 includes joint parts 350C at each of which there is no nozzle combining region 352 illustrated in FIG. 7.

In the ink-jet head 21C illustrated in FIG. 11, head modules 200J are arranged along the X-direction. In the ink-jet head 21C, the planar shape of a surface containing a liquid ejection surface 277C of the head module 200J and the planar shape of the liquid ejection surface 277C are parallelograms.

A joint part 350C illustrated in FIG. 11, in the X-direction, has a previously decided length from a connection position 351 between one of adjacently arranged head modules 200J and the other of the head modules 200J.

The X-directional length of the joint part 350C at which there is no nozzle combining region is decided in consideration of the X-directional length of the joint part in the case where there is the nozzle combining region, and the print resolution.

As an example of the X-directional length of the joint part 350C at which there is no nozzle combining region, there is a mode in which the lengths from the connection position of the two adjacently arranged head modules to both sides in the X-direction are 1 millimeter in the case where the print resolution of each head module is 1200 dots per inch.

The correspondence between the head modules 200J of the ink-jet head 21C illustrated in FIG. 11 and the first head module 200B and second head module 200C illustrated in FIG. 6 and FIG. 7 is the same as the ink-jet head 21A illustrated in FIG. 9 and the ink-jet head 21B illustrated in FIG. 10, and the description is omitted here.

Figure 12:
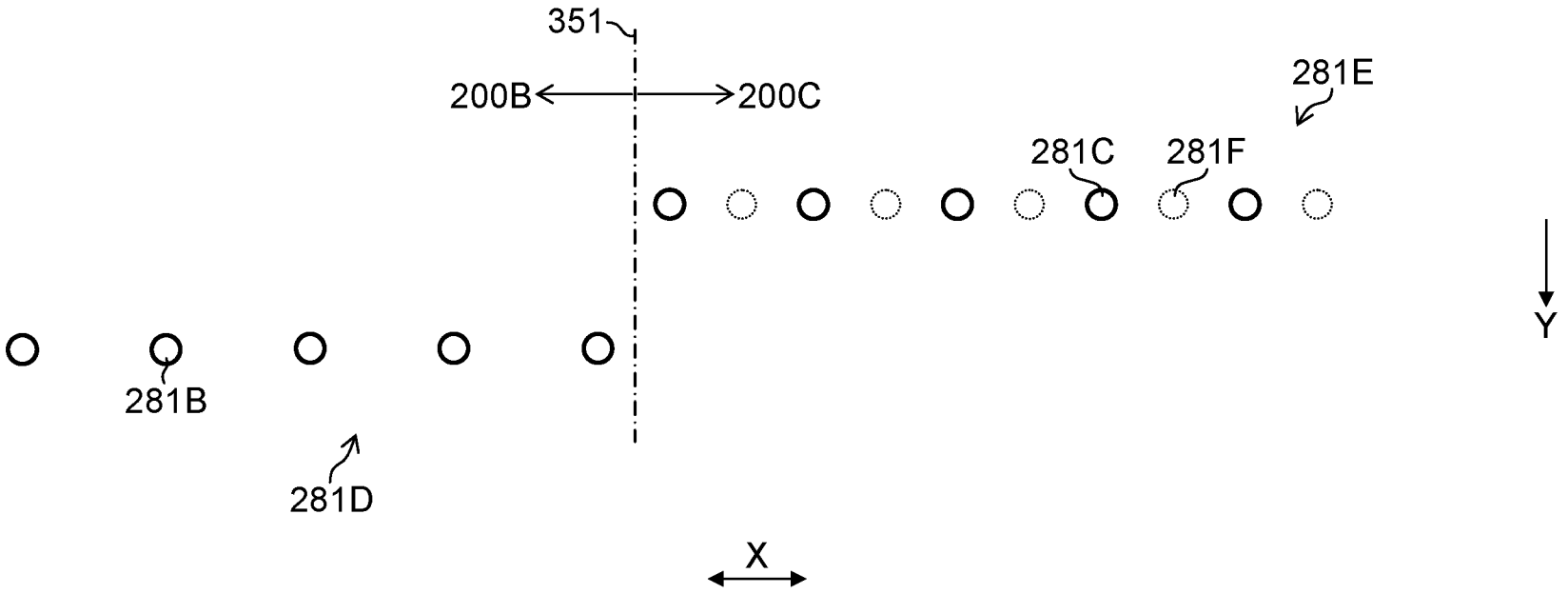
FIG. 12 is an explanatory diagram schematically illustrating an arrangement of nozzle parts at the joint part illustrated in FIG. 11.

FIG. 12 is an explanatory diagram schematically illustrating an arrangement of nozzle parts at the joint part illustrated in FIG. 11. Since there is no nozzle combining region at the joint part 350C illustrated in FIG. 11, the switching between the projected nozzle array 281D and the projected nozzle array 281E is performed at the connection position 351 between the first head module 200B and the second head module 200C, as illustrated in FIG. 12.

The joint parts 350 illustrated in FIG. 9 and FIG. 10 and the joint part 350C illustrated in FIG. 11 are examples. Although the arrangement of the nozzle parts at the joint part varies depending on the arrangement of the nozzle parts in head modules to be used, an ink-jet head production method according to the embodiment can be applied to any arrangement of the nozzle parts.

[Image Quality at Joint Part]

In an ink-jet head having a structure in which a plurality of head modules are arrayed, the deterioration in image quality is likely to appear, at the joint part between adjacently arranged head modules. As a cause for the deterioration in image quality at the joint part, there is a mechanical positional deviation when the head modules are attached. Further, as another cause, there is a lag in ejection timing between the head modules. Furthermore, there is a complex cause of them.

The study by the inventor of the present invention has revealed that the deterioration in image quality at the joint part appears in the case where the ejection volume of the nozzle part arranged at the joint part is less than a standard ejection volume of the head module.

Here, the ejection volume is the volume of unit liquid that is ejected from the nozzle part. The unit liquid is a liquid that forms one dot. As the mode in which the unit liquid is ejected, there is a mode in which all of the liquid that forms one dot is ejected by one ejection operation, or a mode in which all of the liquid that forms one dot is ejected by multiple ejection operations.

The above study for the ejection volume was performed for a droplet type that is highest in use frequency in the case of a high-definition printing. Examples of the high-definition printing include a printing in which the print resolution is 1200 dots per inch. Examples of the droplet type that is highest in use frequency in the case of the high-definition printing include a droplet type having the smallest volume that is used in printing. By the droplet having the smallest volume, a dot having the smallest size that is used in printing is formed.

[Description of Adjustment of Ejection Volume]

For the ink-jet head, there is decided an average ejection volume target value, which is a target value of an average ejection volume that is decided from a specification of the ink-jet recording apparatus. The average ejection volume is an average value of the ejection volumes of all nozzle parts.

In the ink-jet head having a structure in which the plurality of head modules are arrayed, the adjustment of the ejection volume for matching the actual average ejection volume for each head module with the ejection volume target value of the ink-jet head is performed for each head module.

Figure 13:
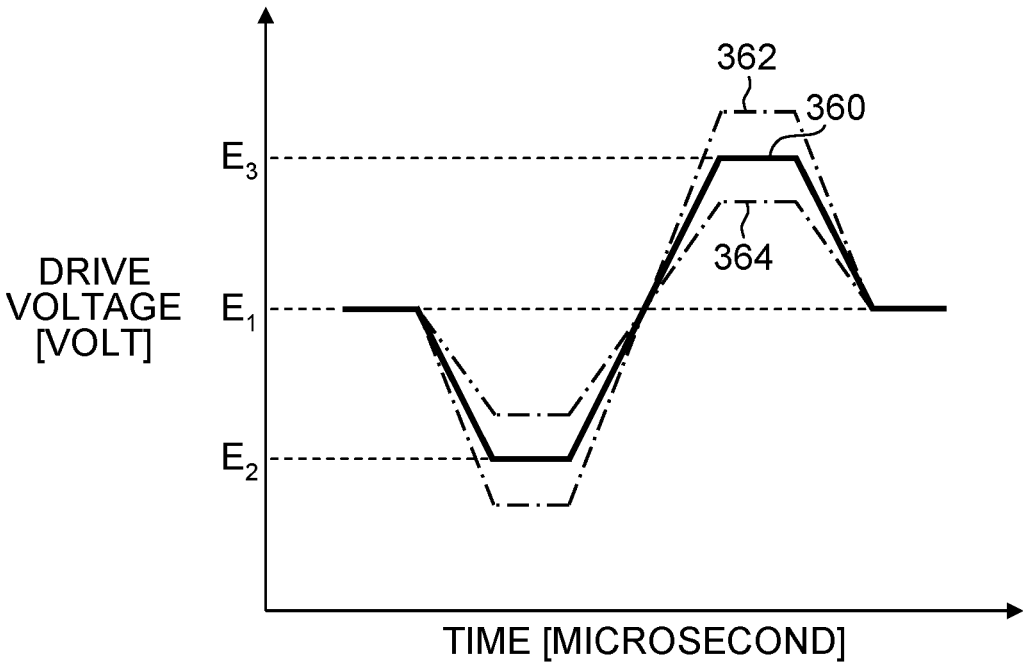
FIG. 13 is an explanatory diagram of amplification factor adjustment of drive voltage.

FIG. 13 is an explanatory diagram of the amplification factor adjustment of the drive voltage. The horizontal series in FIG. 13 indicates time, and the unit is microsecond. The "micro" is an auxiliary unit showing $10^6$-fold. The vertical series in FIG. 13 indicates voltage, and the unit is volt.

A drive voltage 360 illustrated in FIG. 13 is a waveform of the drive voltage that is supplied to the piezoelectric element 230 when the ink is ejected from the nozzle part 281 illustrated in FIG. 4. The drive voltage 360 illustrated in FIG. 13 is a voltage for ejecting the ink in the droplet state from the nozzle opening 280 illustrated in FIG. 4, by transforming the piezoelectric element 230 illustrated in FIG. 4 to contract the pressure chamber 218, expanding the contracted pressure chamber 218 to push put the ink in the pressure chamber 218 from the nozzle opening 280, and restoring the expanded pressure chamber 218 to the former state to divide the ink pushed from the nozzle opening 280.

That is, the drive voltage 360 illustrated in FIG. 13 is a so-called pull-push waveform. A voltage $E_1$ of the drive voltage 360 is a voltage that is supplied to the piezoelectric element 230 when the piezoelectric element 230 illustrated in FIG. 4 is put into a static state.

A voltage $E_2$ of the drive voltage 360 illustrated in FIG. 13 is a voltage that is supplied to the piezoelectric element 230 when the pressure chamber 218 is put into the contracted state by transforming the piezoelectric element 230 illustrated in FIG. 4.

A voltage $E_3$ of the drive voltage 360 illustrated in FIG. 13 is a voltage that is supplied to the piezoelectric element 230 when the pressure chamber 218 is put into the expanded state by transforming the piezoelectric element 230 illustrated in FIG. 4.

By changing the waveform of the drive voltage 360 illustrated in FIG. 13, it is possible to adjust the ejection voltage of the ink that is ejected from the nozzle part.

There is an individual difference in the ejection performance of the head module, and even when an identical drive voltage is supplied, there is a possibility that in some head modules, the actual ejection volumes are less than the target value of the ejection volume, and in some head modules, the actual ejection volumes are greater than the target value of the ejection voltage.

Hence, the drive voltage is adjusted for each head module, and the actual ejection volumes of all head modules are adjusted to the target value of the ejection volume of the ink-jet head.

A drive voltage 362 illustrated in FIG. 13 is a drive voltage that is applied to a head module in which the average ejection volume is less than the average ejection volume target value, and has a waveform resulting from multiplying the waveform of the drive voltage 360 by an amplification factor exceeding 1.

A drive voltage 364 illustrated in FIG. 13 is a drive voltage that is applied to a head module in which the average ejection volume exceeds the average ejection volume target value, and has a waveform resulting from multiplying the waveform of the drive voltage 360 by an amplification factor exceeding 0 and being less than 1.

Figure 14:
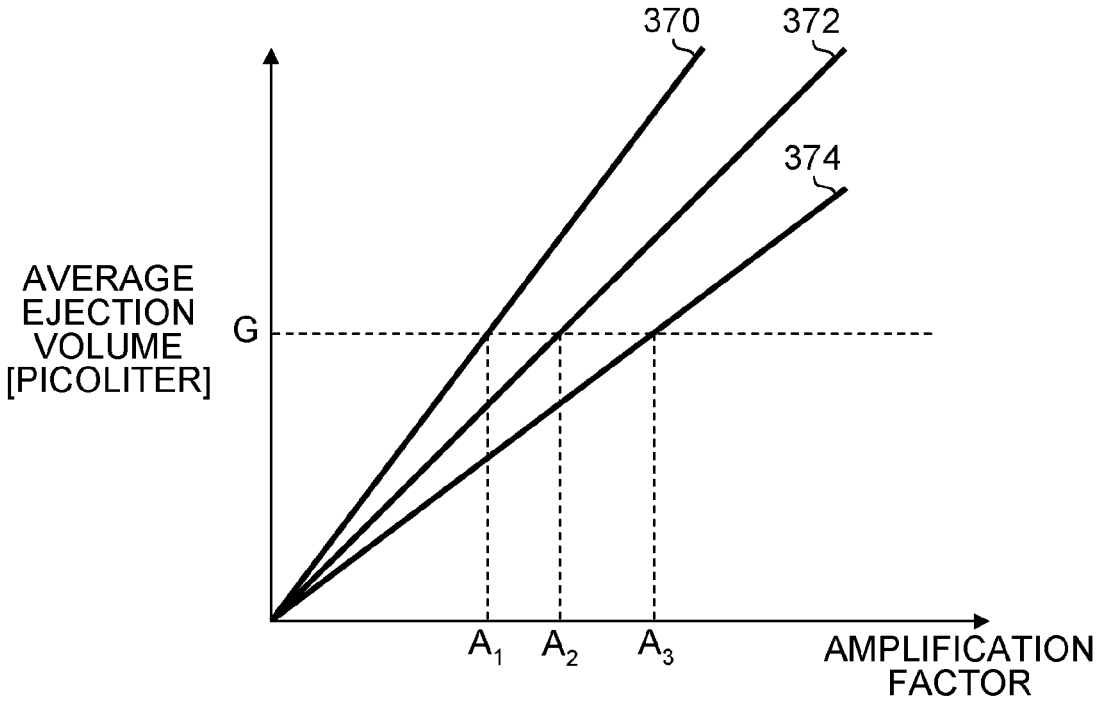
FIG. 14 is an explanatory diagram of the amplification factor of the drive voltage.

FIG. 14 is an explanatory diagram of the amplification factor of the drive voltage. The horizontal series in FIG. 14 indicates the amplification factor of the drive voltage. The vertical series in FIG. 14 indicates the average ejection volume for each head module, and the unit is picoliter. The average ejection volume of the head module is an average value of the ejection volumes of all nozzle parts that are included in the head module, and is calculated by dividing the total sum of the ejection volumes of the nozzle parts by the total number of the nozzle parts. Reference character G illustrated in FIG. 14 designates the target value of the ejection volume that is applied to the ink-jet head.

To a head module having an ejection characteristic to which reference numeral 370 is assigned in FIG. 14, $A_1$ is applied as the amplification factor of the drive voltage. To a head module having an ejection characteristic to which reference numeral 372 is assigned, $A_2$ is applied as the amplification factor of the drive voltage. To a head module having an ejection characteristic to which reference numeral 374 is assigned, A3 is applied as the amplification factor of the drive voltage.

In this way, the amplification factor of the drive voltage is decided for each head module, and the drive voltage is adjusted for each head module. Thereby, the average ejection volumes of all head modules constituting the ink-jet head are adjusted to the average ejection volume target value that is applied to the ink-jet head.

[Description of Ejection Volume Distribution]

Generally, the head module has a distribution of the ejection volume, in the longitudinal direction of the ink-jet head. FIG. 15 to FIG. 22 are explanatory diagrams of the ejection volume distribution of the head module.

The horizontal series in FIG. 15 to FIG. 22 indicates nozzle numbers. The nozzle numbers are consecutive numbers that are assigned in order from a number-1 nozzle part to a number-M nozzle part, where the number-1 nozzle part is the nozzle part at one end or the other end of a projected nozzle array that is an array resulting from projecting the plurality of nozzle parts provided in the head module in the longitudinal direction of the ink-jet head and arranging them along the longitudinal direction of the ink-jet head, and the number-M nozzle part is the nozzle part at the opposite end to the number-1 nozzle part.

The vertical series in FIG. 15 to FIG. 22 indicates the ejection volume for each nozzle part. The unit of the vertical series is picoliter. The prefix "pico" is an auxiliary unit showing $10^{-12}$-fold. The ejection volume of the nozzle part whose nozzle number is 1 is $V_1$, and the ejection volume of the nozzle part whose nozzle number is M is $V_M$.

Figure 15:
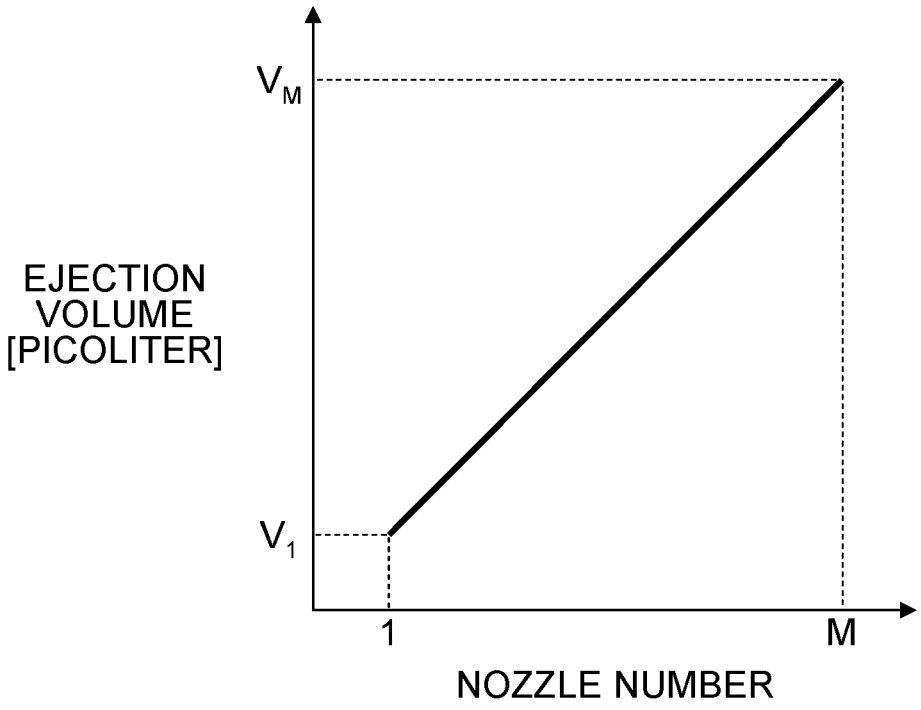
FIG. 15 is an explanatory diagram of an ejection volume distribution of the head module.
Figure 16:
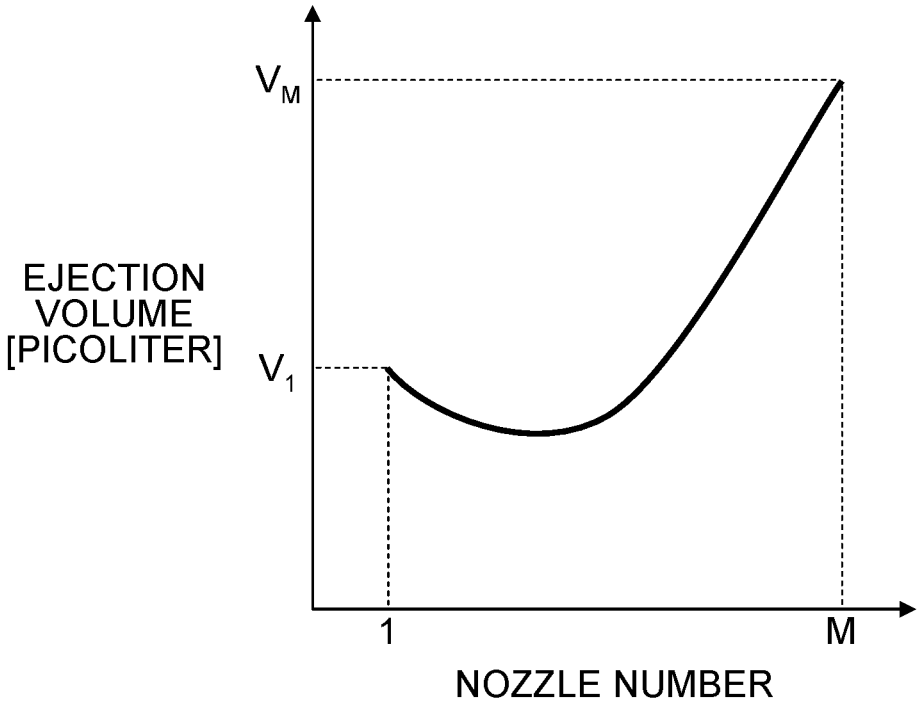
FIG. 16 is an explanatory diagram of an ejection volume distribution of the head module.
Figure 17:
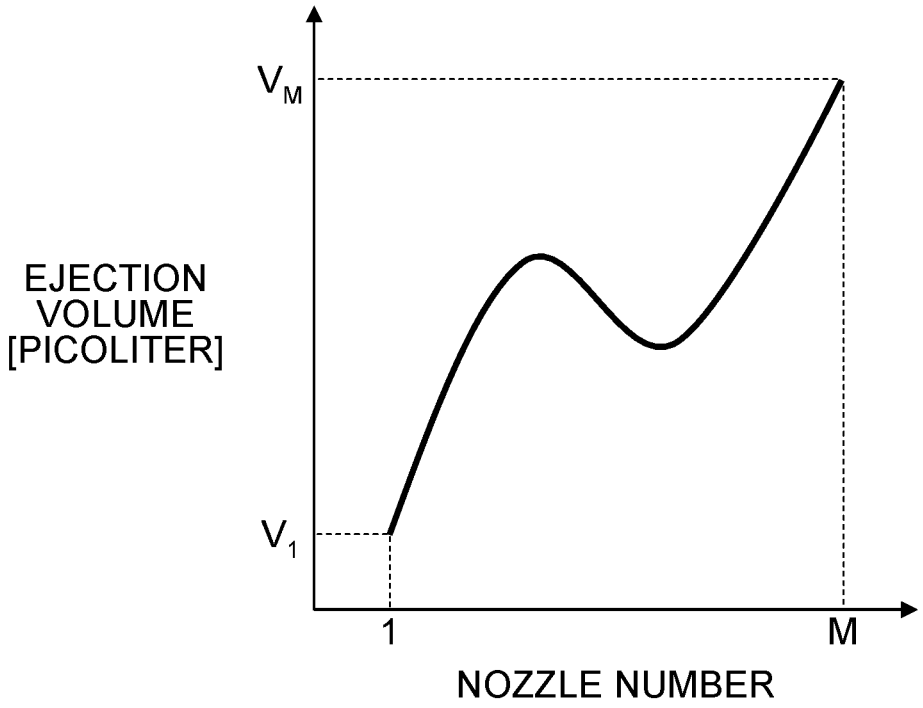
FIG. 17 is an explanatory diagram of an ejection volume distribution of the head module.

The ejection volume distributions of the head module illustrated in FIG. 15 to FIG. 17 are ejection volume distributions when the slope is positive. The slope of the ejection volume distribution of the head module is expressed as $(V_M-V_1)/(M-1)$, by using the ejection volume $V_1$ of the nozzle part whose nozzle number is 1, the ejection volume $V_M$ of the nozzle part whose nozzle number is M, and the total number M of the nozzle parts.

The slope of the ejection volume distribution of the head module is defined as being positive in the case of $V_M-V_1>0$, that is, $V_M>V_1$.

Figure 18:
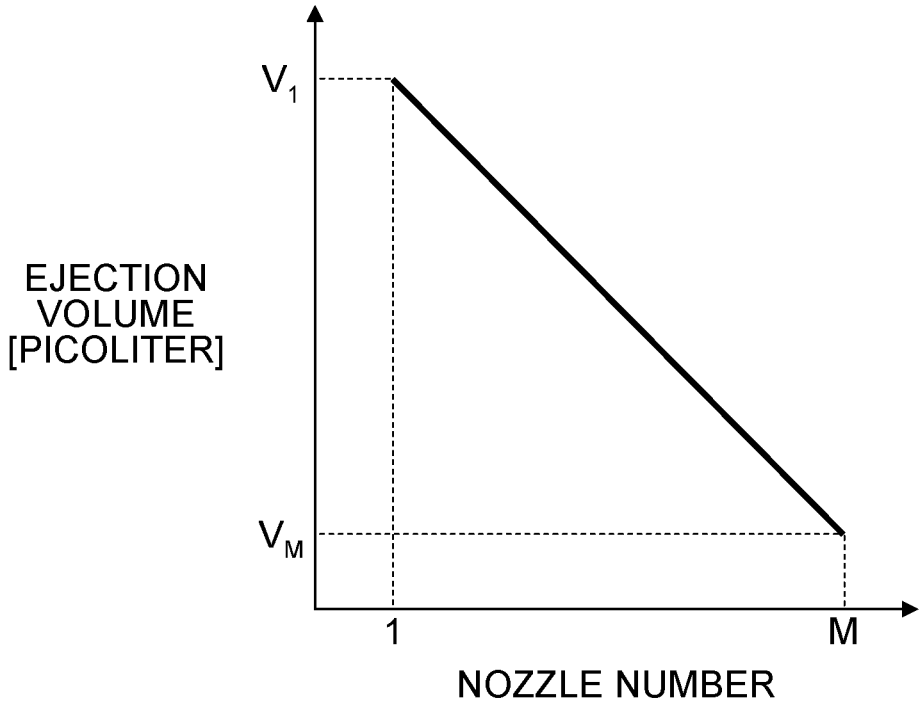
FIG. 18 is an explanatory diagram of an ejection volume distribution of the head module.
Figure 19:
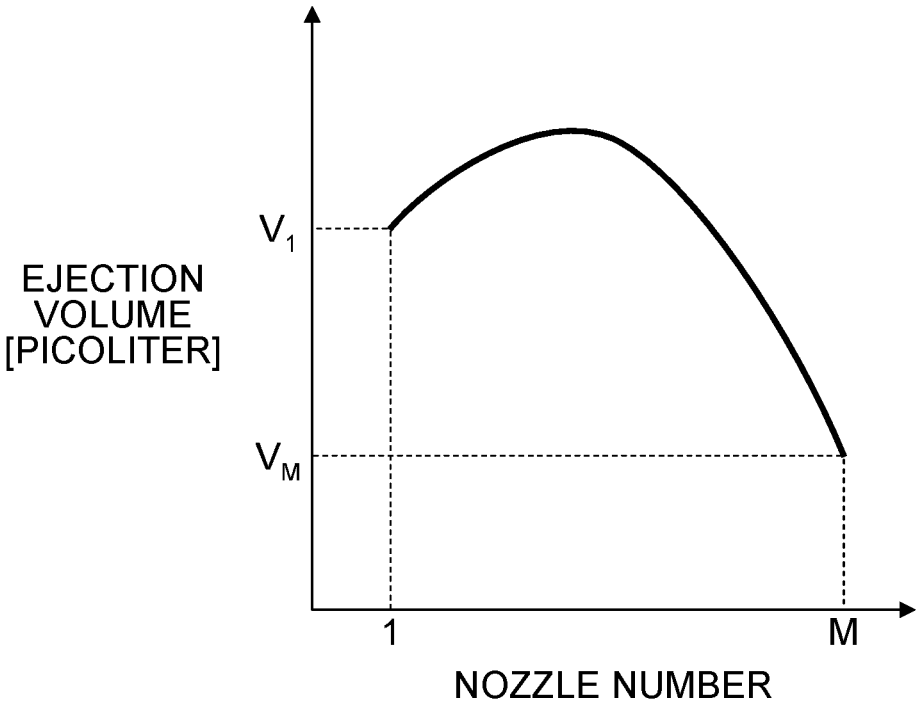
FIG. 19 is an explanatory diagram of an ejection volume distribution of the head module.
Figure 20:
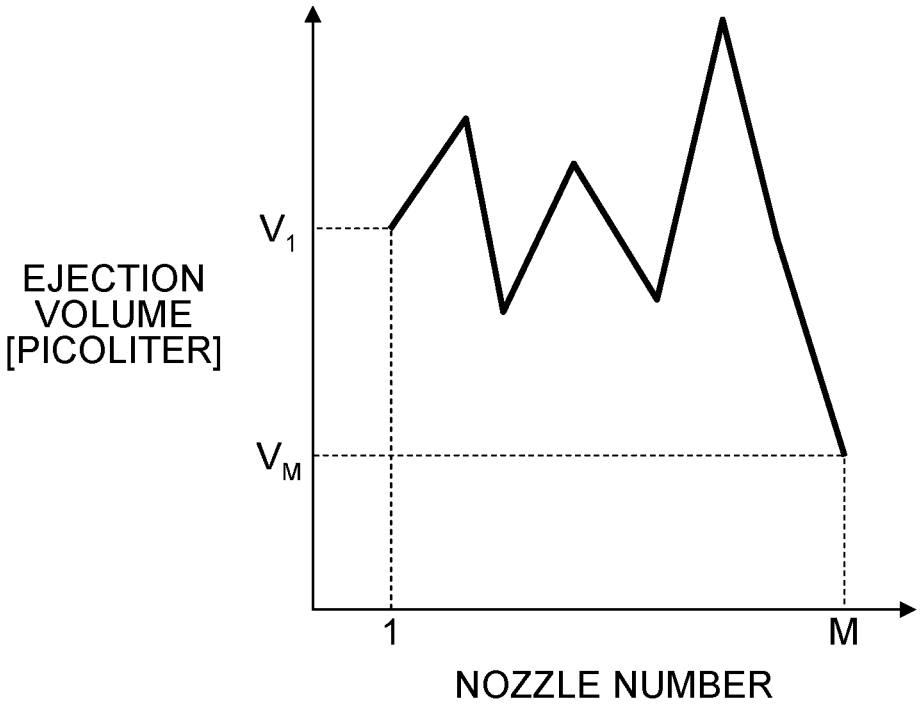
FIG. 20 is an explanatory diagram of an ejection volume distribution of the head module.

The ejection volume distributions of the head module illustrated in FIG. 18 to FIG. 20 are ejection volume distributions when the slope is negative. The slope of the ejection volume distribution of the head module is defined as being negative in the case of $V_M-V_1<0$, that is, $V_M<V_1$.

Figure 21:
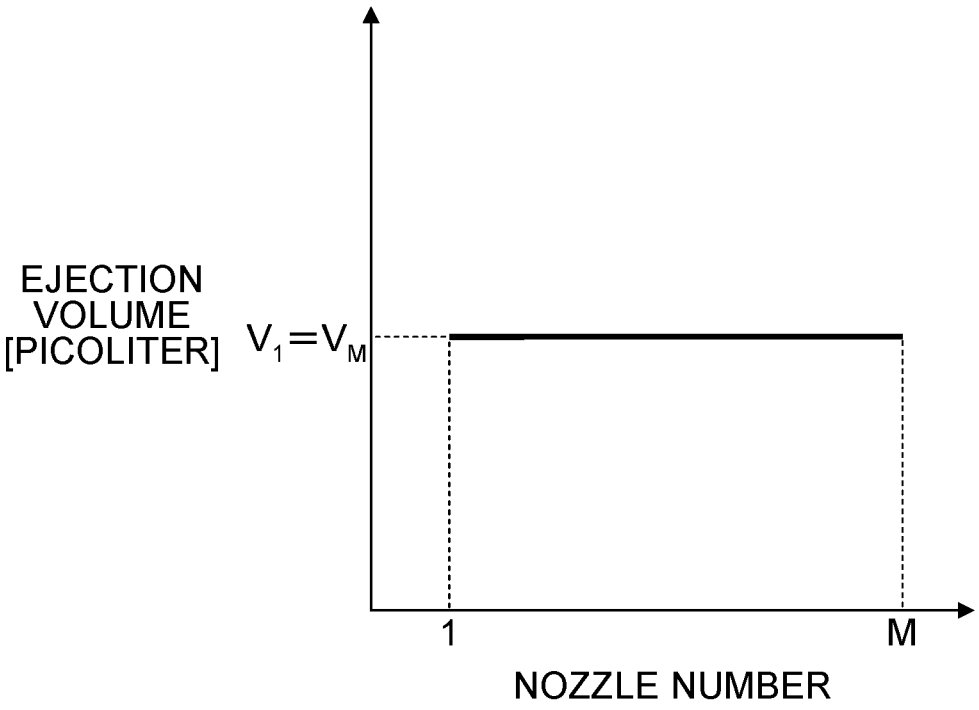
FIG. 21 is an explanatory diagram of an ejection volume distribution of the head module.
Figure 22:
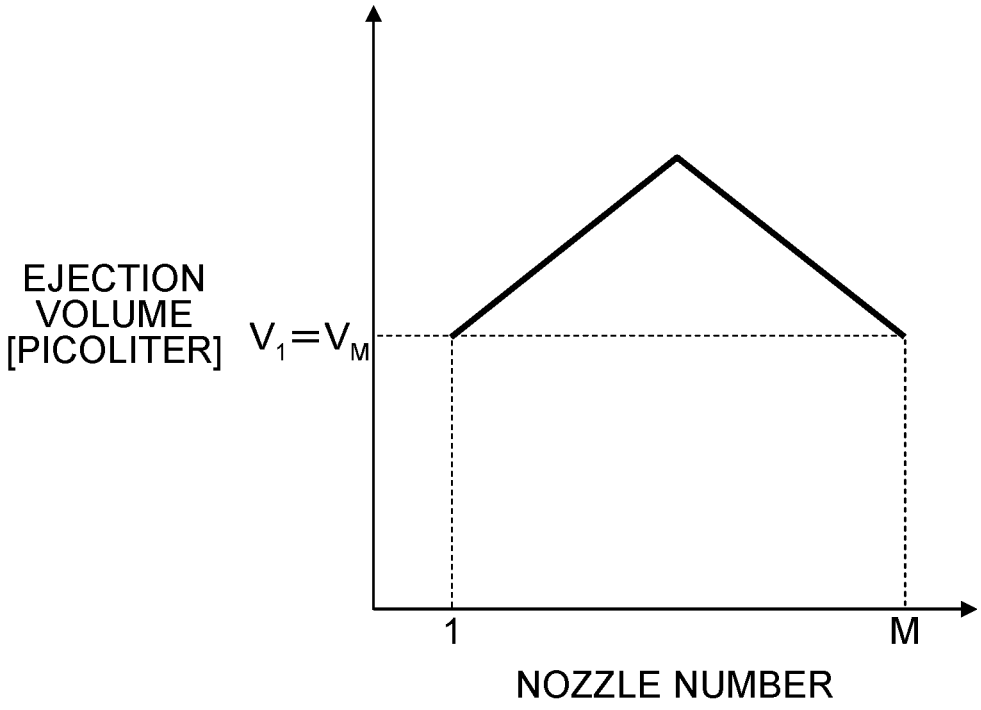
FIG. 22 is an explanatory diagram of an ejection volume distribution of the head module.

The ejection volume distributions of the head module illustrated in FIG. 21 and FIG. 22 are ejection volume distributions when the slope is zero. The slope of the ejection volume distribution of the head module is defined as zero in the case of $V_M-V_1=0$, that is, $V_M=V_1$.

In the embodiment, the slope of the ejection volume distribution is defined using the ejection volume of the nozzle part that is the nozzle part at one end of the head module and whose nozzle number is 1 and the ejection volume of the nozzle part that is the nozzle part at the other end of the head module and whose nozzle number is M. However, the slope of the ejection volume distribution may be defined, for example, using the ejection volume of ten nozzle parts ranging from the nozzle part whose nozzle number is 1 to the nozzle part whose nozzle number is 10 as the ejection volume of the nozzle part at one end part of the head module, and using the ejection volume of ten nozzle parts ranging from the nozzle part whose nozzle number is M-9 to the nozzle part whose nozzle number is M as the ejection volume of the nozzle part at the other end part of the head module.

In other words, the slope of the ejection volume distribution of the head module can be defined using the ejection volume of a single or a plurality of nozzle parts arranged at one end part of the head module and the ejection volume of a single or a plurality of nozzle parts arranged at the other end part of the head module on the projected nozzle array illustrated in FIG. 3.

Examples of the one end part of the head module and the other end part of the head module include regions where a plurality of nozzles parts to be arranged at both ends of the head module or at the joint parts are arranged.

In the case where the slope of the ejection volume distribution of each head module is defined using the ejection volume of a plurality of nozzles, a representative value such as average value, maximum value or minimum value can be used as the ejection volume of the plurality of nozzles. In the embodiment, the average value is used as the ejection volume of the plurality of nozzles.

As illustrated in FIG. 15 to FIG. 22, the head module has a distribution of the ejection volume in the longitudinal direction of the ink-jet head, and therefore, at the joint part 350 illustrated in FIG. 6 and FIG. 7, there can be a difference between the ejection volume of the nozzle parts belonging to the first head module 200B and the ejection volume of the nozzle parts belonging to the second head module 200C, even when the average ejection volume of the each head module is adjusted to the average ejection volume target value of the ink-jet head.

Hence, as illustrated below, the arrangement of the head modules is set in consideration of the ejection volumes of the nozzle parts arranged at the joint parts between two head modules that are arranged at adjacent positions, and thereby, the deterioration in image quality at the joint parts is suppressed.

The ejection volume of the nozzle parts arranged at the joint part between the head modules can be evaluated using the ejection volume distribution of the head module illustrated in FIG. 15 and FIG. 22 and the average value of the ejection volumes of all nozzle parts of the head module.

At the time of the shipment inspection of the head modules, the information about the ejection volume distribution and the information about the average ejection volume of all nozzle parts are examined and stored. Thereby, after the shipment of the head modules, it is possible to derive the representative value of the ejection volumes at the joint part between the head modules, using the information about the ejection volume distribution and the information about the average ejection volume of all nozzle parts. Examples of the information about the ejection volume distribution include the information about the slope of the ejection volume distribution.

[Description of Ink-Jet Head Production Method]

Next, an ink-jet head production method according to the embodiment is described in detail. The ink-jet head production method in the embodiment corresponds to the liquid ejection head production method.

The ink-jet head production method according to the embodiment includes a production method for the reproduction of the ink-jet head when a single or a plurality of head modules of the plurality of head modules constituting the ink-jet head are replaced.

<Overview>

In the ink-jet head production method according to the embodiment, at the joint part between two head modules that are arranged at adjacent positions, two head modules for which the average value $V_{ave}$ of a first representative value $V_{typ1}$, which is a representative value of the ejection volumes of nozzle parts that belong to the first head module as one head module and that are arranged at the joint part, and a second representative value $V_{typ2}$, which is a representative value of the ejection volumes of nozzle parts that belong to the second head module as the other head module and that are arranged at the joint part, satisfies a condition shown by the following Formula (1) are set as the two head modules that are arranged at the adjacent positions.

$$0.76\times G\leq V_{ave}\leq 1.24\times G \quad (1)$$

The relation of the average value $V_{ave}$ in the above Formula (1), the first representative value $V_1$ and the second representative value $V_{typ2}$ is expressed by the following Formula (2).

$$V_{ave}=(V_{typ1}+V_{typ2})/2$$

The first representative value $V_1$ and the second representative value $V_{typ2}$ may be the average values of the ejection volumes of the nozzle parts arranged at the joint parts of the head modules, or may be the median values of the ejection volumes of the nozzle parts arranged at the joint parts of the head modules. The average value facilitates the derivation process, compared to the median value. The median value has resistance to noises caused by a measurement mistake or the like, compared to the average value.

In the head module that is applied to the ink-jet head production method according to the embodiment, the average ejection volume of all nozzle parts is adjusted to a previously decided target value, at the time of the shipment inspection. In the case of knowing the average ejection volume target value of the ink-jet head in which the inspection-object head module is used, the average ejection volume target value of the ink-jet head in which the inspection-object head module is used is applied as the target value of the average ejection volume that is applied at the time of the shipment inspection.

<Description of Flowchart>

Figure 23:
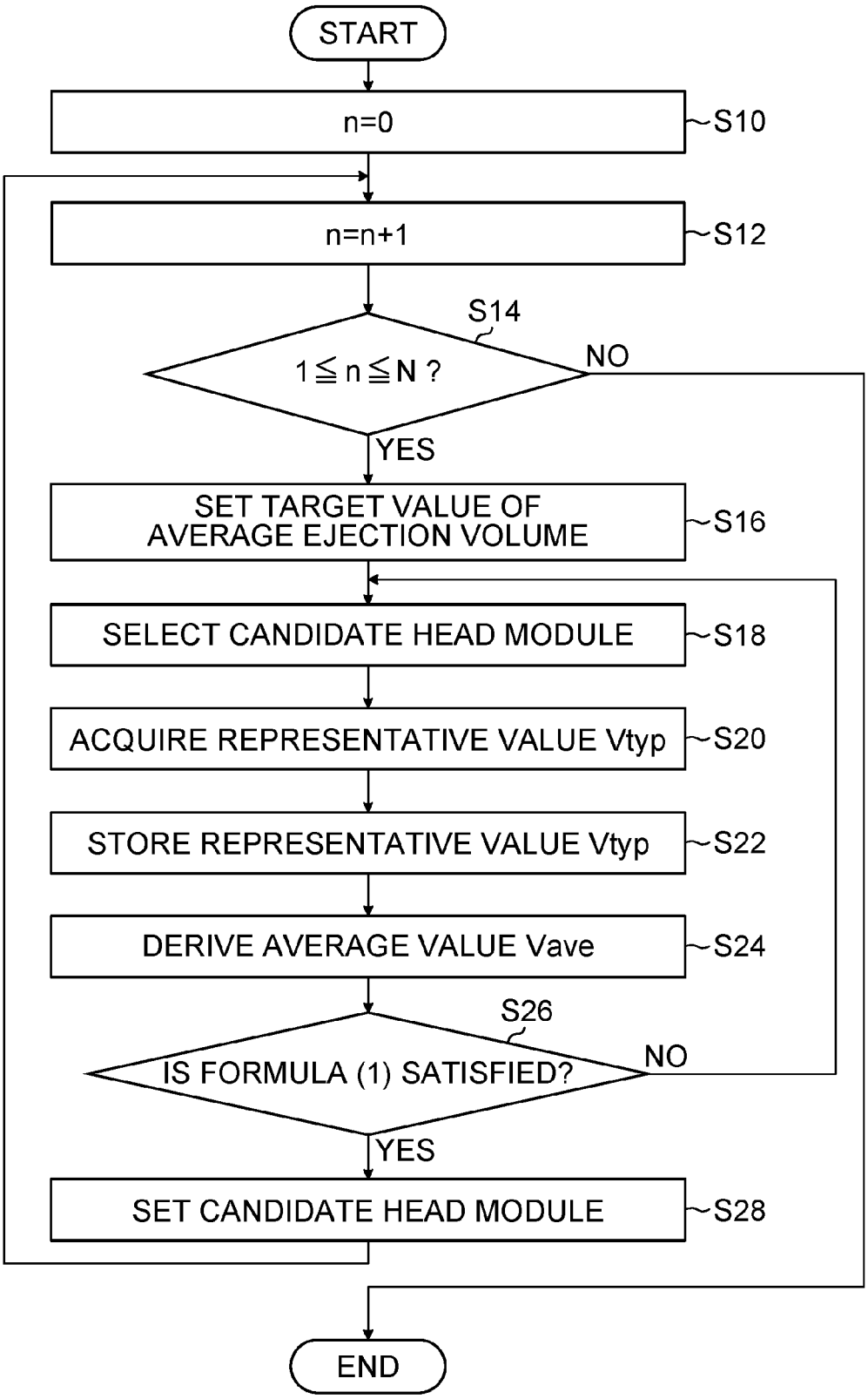
FIG. 23 is a flowchart illustrating a flow of an ink-jet head production method.

FIG. 23 is a flowchart illustrating a flow of the ink-jet head production method. In the ink-jet head production method described below, the head module to be arranged at the arrangement position of each head module number n is set in the order of the head module number n, from a head module whose head module number n is 1.

That is, the first representative value $V_{typ1}$ is known, the second representative value $V_{typ2}$ is acquired, the average value $V_{ave}$ of the first representative value $V_{typ1}$ and the second representative value $V_{typ2}$ is derived, and the second head module is decided in the case where the average value $V_{ave}$ satisfies the above Formula (1).

Further, in the ink-jet head production method described below, the average value of the ejection volumes is applied as the representative value $V_{typ1}$ and representative value $V_{typ2}$ of the ejection volumes of the head module.

In an initialization step shown in step S10 of FIG. 23, the head module number n is initialized. That is, zero is substituted for the head module number n.

The head module numbers n are numbers that are assigned in order from a number-1 head module, where the number-1 head module is the head module at one end in the longitudinal direction of the ink-jet head. The head module number n is an integer of 1 or more, and an integer equal to or less than the total number N of the head modules provided in the ink-jet head is used. In the embodiment, for convenience, the one end in the longitudinal direction of the ink-jet head 21 illustrated in FIG. 1 is the end on the left side in FIG. 1.

In a head module number advancement step shown in step S12, a process of incrementing the head module number n by one is executed. That is, after a head module to be set as the number-n head module is decided, the flow proceeds to a process of setting the number-n+1 head module.

In an all-module setting determination step shown in step S14, whether the head module number n updated in the head module number advancement step S12 has been set for all head modules that are arranged at the arrangement positions of 1 to N is determined. In the case of a NO determination in which all head modules have been decided in step S14, that is, in the case of n>N, the ink-jet head production method is ended. In the case of a YES determination in which there is an undecided head module in the all-module setting determination step S14, that is, in the case of 1≤n≤N, the flow proceeds to step S16.

In average ejection volume target value setting step shown in step S16, the average ejection volume target value G of the ink-jet head is set. The setting of the average ejection volume target value G of the ink-jet head may be automatically performed from the information relevant to the specification of the ink-jet recording apparatus on which the ink-jet head is mounted, or may be performed through a manual input by an operator.

In a candidate head module selection step shown in step S18, a candidate head module that is the object of the process is selected. After the candidate head module is selected in the candidate head module selection step S18, the flow proceeds to step S20.

In the case where the head module number n is 1, the candidate head module selection step S18 corresponds to the first candidate head module selection step of selecting the first candidate head module. In the case where the head module number n is 2 or more, the candidate head module selection step S18 corresponds to the second candidate head module selection step of selecting the second candidate head module.

In a representative value acquisition step shown in step S20, the representative value $V_{typ}$ of the ejection volumes of the nozzle parts arranged at the joint part of the candidate head module is acquired, and in a representative value storage step shown in step S22, the acquired representative value $V_{typ}$ is stored in a previously decided memory.

In the case where the head module number n is 2 or more and the second representative value $V_{typ2}$ is stored, the representative value stored as the second representative value $V_{typ2}$ is read as the first representative value $V_{typ1}$, in the process for the head module having the next head module number.

After the representative value $V_{typ}$ is stored in the representative value storage step S22, the flow proceeds to step S24. The representative value $V_{typ}$ is a collective term for the representative value $V_{typ1}$ of the first candidate head module and the representative value $V_{typ2}$ of the second candidate head module.

As the mode of the acquisition of the representative value $V_{typ}$ in the representative value acquisition step S20, there is a mode of acquiring the first representative value $V_{typ1}$ that is the representative value of the first candidate head module, in the case where the head module number n is 1, and there are a mode of reading the previously stored first representative value $V_{typ1}$ and a mode of acquiring the second representative value $V_{typ2}$ that is the representative value of the second candidate head module, in the case where the head module number n is 2 or more.

In the case where the head module number n is 1, the representative value acquisition step S20 corresponds to the first representative value acquisition step. In the case where the head module number n is 2 or more, the representative value acquisition step S20 corresponds to the first representative value acquisition step and the second representative value acquisition step.

In the case where the head module number n is 1, the representative value storage step S22 corresponds to the first representative value storage step. In the case where the head module number n is 2 or more, the representative value storage step S22 corresponds to the second representative value storage step.

After the representative value $V_{typ}$ is acquired in the representative value acquisition step S20 and the representative value $V_{typ}$ is stored in the representative value storage step S22, the process proceeds to step S24.

In an average value derivation step shown in step S24, the average value $V_{ave}$ of the first representative value $V_{typ1}$ and the second representative value $V_{typ2}$ is derived using the first representative value $V_{typ1}$ and second representative value $V_{typ2}$ stored in the representative value storage step S22. The derived average value $V_{ave}$ is stored in a previously decided memory.

After the average value $V_{ave}$ is derived and stored in the average value derivation step S24, the flow proceeds to step S26. In the case where the head module number n is 1, the average value $V_{ave}$ cannot be derived because the second representative value $V_{typ2}$ is not acquired, and therefore, the average value derivation step S24 is skipped.

In a determination step shown in step S26, whether the average value $V_{ave}$ derived in the average value derivation step S24 satisfies the above Formula (1) is determined.

In the case where the average value $V_{ave}$ satisfies Formula (1), which the case of YES determination in the determination step S26, the flow proceeds to step S28. In a setting step shown in step S28, the candidate head module is set as the number-n head module. In the case where the head module number n is 1, step S24 is skipped, and the flow proceeds to step S28.

The setting step S26 in the embodiment is a mode of the first head module setting step. Further, the setting step S26 in the embodiment is a mode of the second head module setting step.

On the other hand, in the case where the average value $V_{ave}$ does not satisfy Formula (1), which the case of the NO determination in the determination step S26, the flow proceeds to the candidate head module selection step S18, and another head module is selected as the candidate head module. Thereafter, the steps of step S18 to step S26 are repeatedly executed until the head module to be set is found.

After the head module whose head module number is n is set in the setting step S28, the steps of step S12 to step S28 are repeatedly executed until the N head modules are set.

Thus, the ink-jet head satisfying the condition that, for two head modules arranged at positions that are adjacent in the longitudinal direction of the ink-jet head, the average value $V_{ave}$ of the representative value $V_{typ1}$ of the ejection volumes of the nozzle parts arranged at the joint part of the first head module as one head module and the representative value $V_{typ2}$ of the ejection volumes of the nozzle parts arranged at the joint part of the second head module as the other head module is 0.76-fold or more and 1.24-fold or less of the average ejection volume target value G is produced.

FIG. 23 exemplifies the mode of setting the head modules in the order of the head module number from the head module whose head module number is 1 while the head module at one end of the ink-jet head is adopted as the head module whose head module number is 1. However, the head modules may be set in the order from the head module at the center of the ink-jet head, to both sides.

In such a mode, the second candidate head module is sometimes selected for the adjacent position on the one side of the first head module and the adjacent position on the other side.

[Evaluation of Image Quality]

A test by the inventor has revealed that there is no problem in image quality in the case where the ejection volume at the joint part satisfies the above Formula (1). The test result is shown in the following [Table 1].

TABLE 1

| Amplification factor | 0.70 | 0.76 | 0.80 | 0.85 | 0.90 | 0.95 | 1.00 | 1.05 | 1.10 | 1.15 | 1.20 | 1.24 | 1.30 |
|---|---|---|---|---|---|---|---|---|---|---|---|---|---|
| Evaluation | C | B | B | A | A | A | A | A | A | A | B | B | C |

In the test for which the test result is shown in the above [Table 1], the ejection volume for each head module was changed in stages, and thereby, the average value $V_{ave}$ was changed. The images at joint parts different in the value of the average value $V_{ave}$ were visually observed, and the image qualities were classified into three stages. For the change in the ejection volume for each head module, the change in the amplification factor of the drive voltage described with use of FIG. 13 and FIG. 14 was applied.

A in the above [Table 1] shows that the image quality is good. B shows that the image quality is in the allowable limit. C shows that the image quality is lower than the allowable limit.

In the test for which the result is shown in the above [Table 1], the average value of the ejection volumes of the head module was used as the representative value $V_{typ}$ of the ejection volumes of the head module at the time of the derivation of the average value $V_{ave}$. The representative value $V_{typ}$ of the ejection volumes of the head module herein is a collective term for the first representative value $V_{typ1}$ and the second representative value $V_{typ2}$ described above.

The numerical values of the amplification factor column in the above [Table 1] are amplification factors by which the average ejection volume target value G of the ink-jet head is multiplied. According to the above [Table 1], the image quality at the joint part is allowable in the case where the value of the average value $V_{ave}$ is 0.76×G or more and 1.24×G or less.

That is, when the average value $V_{ave}$ is 0.76×G or more, the state of a too-small ejection volume that causes the deterioration in image quality at the joint part is avoided, and when the average value $V_{ave}$ is 1.24×G or less, the deterioration in graininess due to a dot enlargement associated with the state of a too-large ejection volume is suppressed.

The following [Table 2] shows a test result for the image quality at the joint part in the case where the median value of the ejection volumes of the head module was used as the representative value $V_{typ}$ of the ejection volumes of the head module at the time of the derivation of the average value $V_{ave}$.

TABLE 2

| Amplification factor | 0.70 | 0.76 | 0.80 | 0.85 | 0.90 | 0.95 | 1.00 | 1.05 | 1.10 | 1.15 | 1.20 | 1.24 | 1.30 |
|---|---|---|---|---|---|---|---|---|---|---|---|---|---|
| Evaluation | C | B | B | A | A | A | A | A | A | A | B | B | C |

As shown in the above [Table 2], even in the case where the median value of the ejection volumes of the nozzle parts arranged at the joint part of the head module was used as the representative value $V_{typ}$ of the ejection volumes of the nozzle parts arranged at the joint part of the head module at the time of the derivation of the average value $V_{ave}$, the same result as in the case where the average value of the ejection volumes of the nozzle parts arranged at the joint part of the head module was used as the representative value $V_{typ}$ of the ejection volumes of the head module was obtained.

[Description of Derivation of Representative Value $V_{typ}$]

At the time of the shipment inspection of the head module, for each head module, it is preferable to acquire the representative value $V_{typ}$ of the ejection volumes of the nozzle parts arranged at the joint part of each head module, which is the information to be used in the derivation of the average value $V_{ave}$.

The nozzle parts arranged at the joint part of the head module are present on both side of the head module in the longitudinal direction of the ink-jet head. Therefore, for a single head module, the representative value $V_{typ}$ of the ejection volumes of the nozzle parts arranged at the joint part is evaluated for each of one side and the other side in the longitudinal direction of the ink-jet head.

The representative value $V_{typ}$ of the ejection volumes of the nozzle parts arranged at the joint part can be derived from the ejection volume of each nozzle part arranged at the joint part.

In the following, methods for deriving the ejection volume of each nozzle part are described. Suppose that the average of the ejection volume in the whole of each head module has been adjusted to the average ejection volume target value of the ink-jet head in advance, at the time of the execution of the methods for deriving the ejection volume of each nozzle part described below.

In other words, suppose that the amplification factor of the drive voltage of each head module has been evaluated in advance, at the time of the execution of the methods for deriving the ejection volume of each nozzle part.

In the case where redundant nozzle parts are included in the joint part, the representative value $V_{typ}$ including the ejection volumes of the redundant nozzle parts may be derived.

<Method 1>

A dot diameter evaluation chart is formed, using a head module that is the object of the derivation of the representative value $V_{typ}$. Examples of the dot diameter evaluation chart include a chart in which the dots formed by the nozzle parts are arranged in an isolated state.

Figure 24:
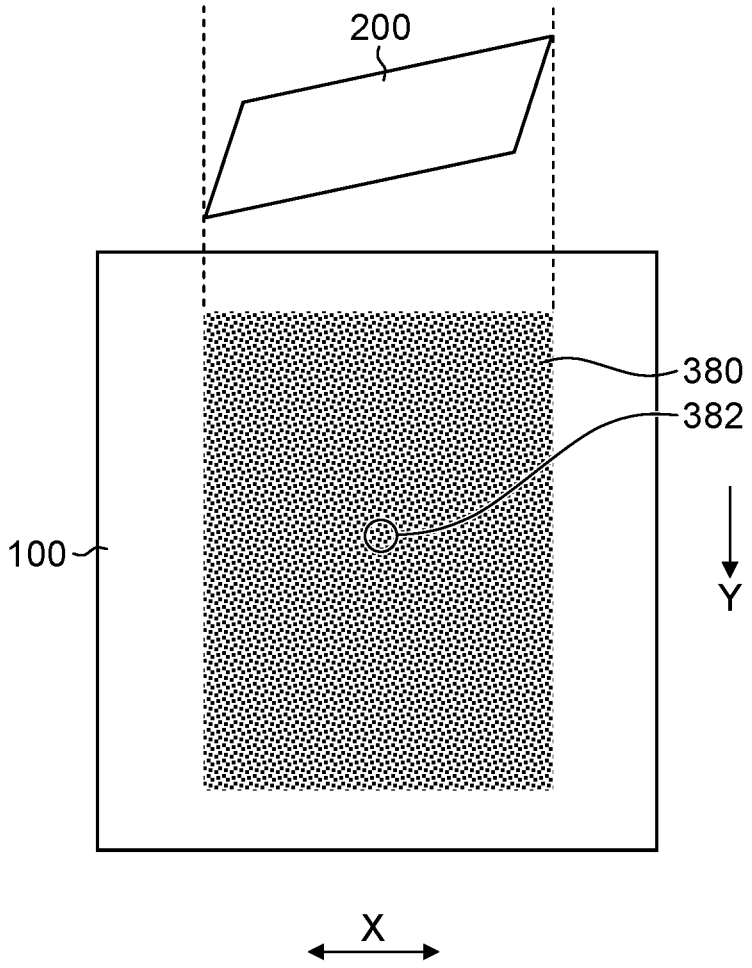
FIG. 24 is an explanatory diagram schematically illustrating an example of a dot diameter evaluation chart.
Figure 25:
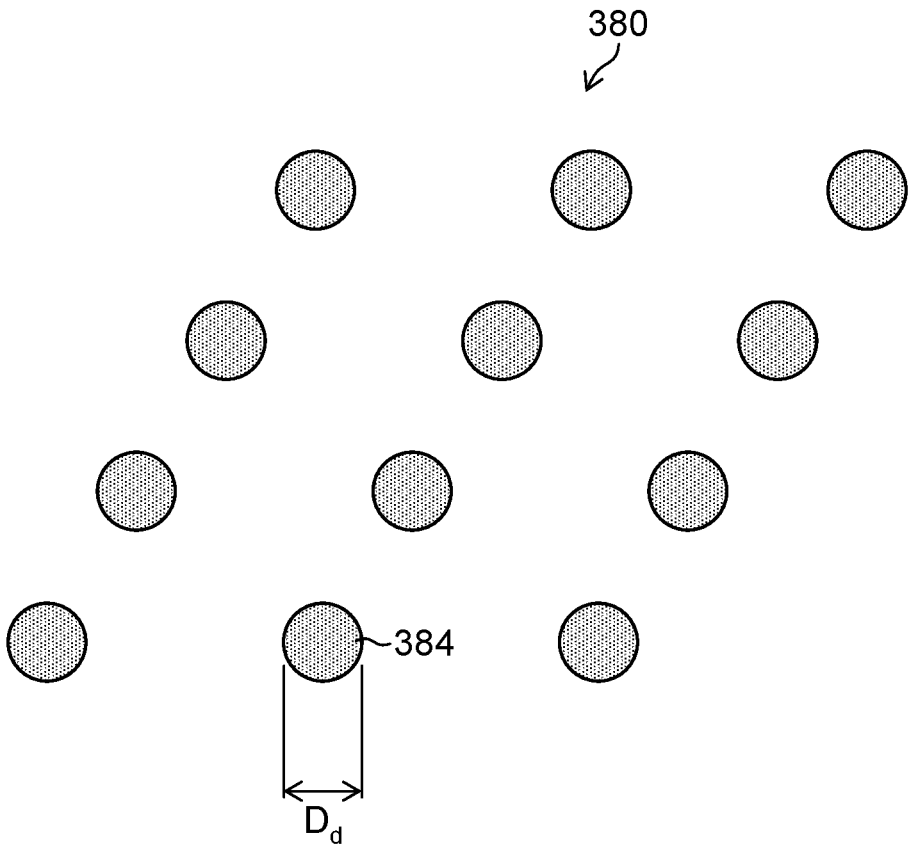
FIG. 25 is a partial enlarged view of FIG. 24.

FIG. 24 is an explanatory diagram schematically illustrating an example of the dot diameter evaluation chart, and schematically illustrates a dot diameter evaluation chart 380 that is formed on the medium 100 using the head module 200. FIG. 25 is a partial enlarged view of FIG. 24, and is an enlarged view of the region illustrated by a circle that is illustrated in FIG. 24 while reference numeral 382 is assigned.

The dot diameter evaluation chart 380 illustrated in FIG. 24 and FIG. 25 is read using a scanner, a microscope or the like, and the diameter $D_d$ of a dot 384 formed by each nozzle part is measured.

The diameter $D_d$ of the dot formed by each nozzle part can be converted into the ejection volume $V_d$ of each nozzle part, using an expansion ratio $K_d$ decided from the kind of the medium 100 on which the dot diameter evaluation chart 380 is formed and the surface treatment condition of the medium 100 on which the dot diameter evaluation chart 380 is formed. The relation of the ejection volume $V_d$ of each nozzle part, the diameter $D_d$ of the dot 382 formed by each nozzle part and the expansion ratio $G_{ad}$ is expressed as $V_d=D_d/G_{ad}$.

Here, as the way to decide the expansion ratio $G_{ad}$, the expansion ratio can be decided in advance, by printing the dot while feeding the medium in a state of ensuring that a liquid having a known volume is ejected from an arbitrary nozzle part, and using the known ejection volume and the diameter of the printed dot.

<Method 2>

A line width evaluation chart is formed, using an object head module. Examples of the line width evaluation chart include a chart in which lines formed by the nozzle parts and having a certain length are arranged in an isolated state.

Figure 26:
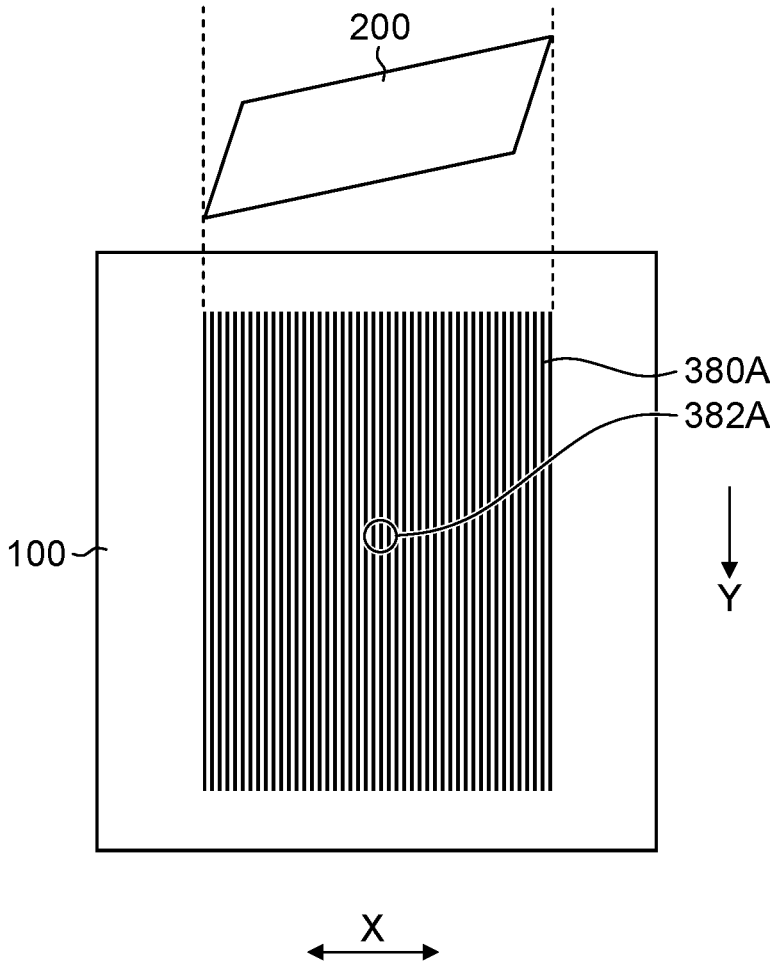
FIG. 26 is an explanatory diagram schematically illustrating an example of a line width evaluation chart.
Figure 27:
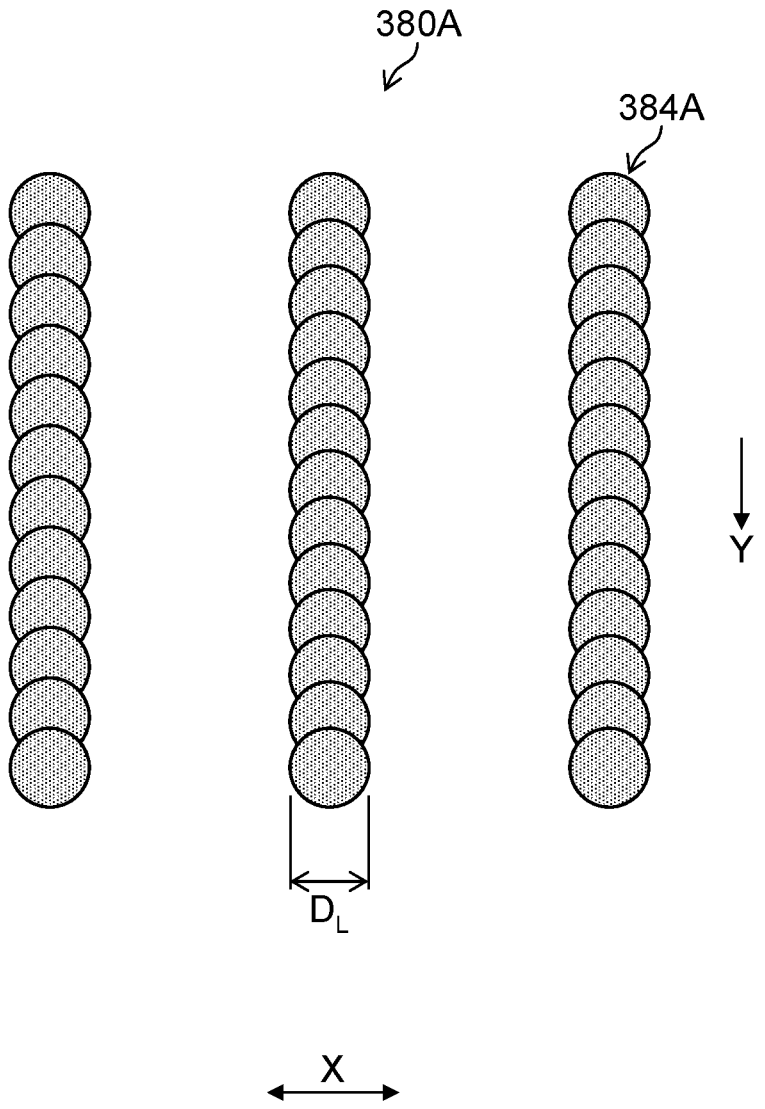
FIG. 27 is a partial enlarged view of FIG. 26.

FIG. 26 is an explanatory diagram schematically illustrating an example of the line width evaluation chart, and schematically illustrates a line width evaluation chart 380A that is formed on the medium 100 using the head module 200. FIG. 27 is a partial enlarged view of FIG. 26, and is an enlarged view of the region illustrated by a circle that is illustrated in FIG. 26 while reference character 382A is assigned.

The line width evaluation chart 380A illustrated in FIG. 26 and FIG. 27 is read using a scanner, a microscope or the like, and the width $D_L$ of a line 384A formed by each nozzle part is measured. The relation of the width $D_L$ of the line and the ejection volume $V_L$ is decided from the kind of the medium 100 on which the line width evaluation chart 380A is formed and the surface treatment condition of the medium 100 on which the line width evaluation chart 380A is formed, and therefore, by previously acquiring the information about the kind of the medium 100 on which the line width evaluation chart 380A is formed and the information about the surface treatment condition of the medium 100 on which the line width evaluation chart 380A is formed, it is possible to convert the measurement result of the width $D_L$ of the line 384A formed by each nozzle part into the ejection volume $V_L$ of each nozzle part.

The relation of the ejection volume $V_L$ of each nozzle part, the width $D_L$ of the line 384A formed by each nozzle part and a coefficient $G_{aL}$ to be decided from the kind or surface treatment condition of the medium 100 can be expressed as $V_L=D_L/G_{aL}$.

<Method 3>

The mass of the liquid ejected from each nozzle part of an object head module is measured, and the mass of the liquid ejected from each nozzle part is converted into the volume. For example, the ejection is performed from each nozzle part of the object head module a previously decided number of times, and the mass difference of the medium between before and after the ejection is measured. It is possible to keep the measurement accuracy constant, by increasing the number of times of the ejection. It is preferable that the number of times of the ejection be approximately ten thousands to one million.

The mass difference of the medium between before and after the ejection is the mass of the liquid that is ejected a previously decided number of times of the ejection. The mass of the liquid can be converted into the volume, using the specific gravity of the liquid.

The relation of the ejection volume $V_W$ of each nozzle part, the mass W of the liquid ejected from each nozzle part, the specific gravity $d_W$ of the liquid and the number $T_W$ of times of the ejection of each nozzle part can be expressed as $V_W=W/T_W/d_W$.

For maintaining a certain level of measurement accuracy and shortening the measurement period, the ejections from a plurality of nozzle parts may be simultaneously performed a previously decided number of times, and the mass difference of the medium between before and after the ejection may be measured. When the nozzle parts arranged at the joint part are applied as the plurality of nozzle parts, the mass of the liquid that is ejected from the nozzle parts arranged at the joint part is measured, and the ejection volume of the nozzle parts arranged at the joint part is evaluated.

Figure 28:
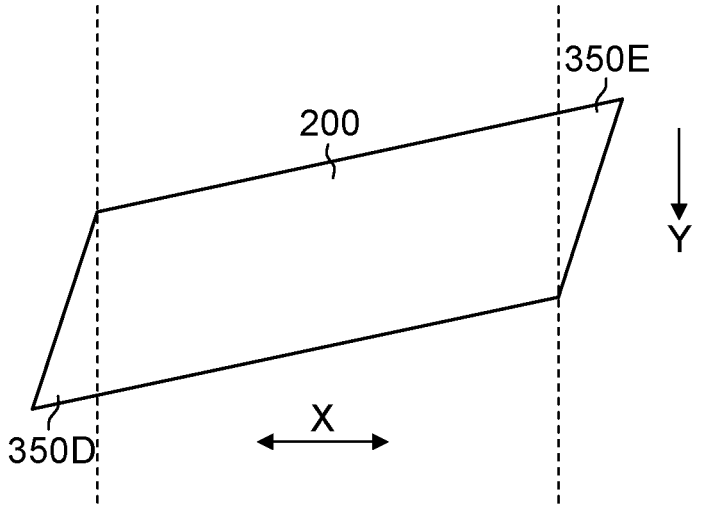
FIG. 28 is an explanatory diagram of an example in which nozzle parts arranged at the joint part are applied as a plurality of nozzle parts.

FIG. 28 is an explanatory diagram of an example in which the nozzle parts arranged at the joint part are applied as the plurality of nozzle parts. As illustrated in FIG. 28, the ejection volume of the nozzle parts arranged at a joint part 350D on one end side in the longitudinal direction of the ink-jet head and the ejection volume of the nozzle parts arranged at a joint part 350E on the other end side in the longitudinal direction of the ink-jet head are measured.

The ejection volume of each nozzle part in the case of using a plurality of nozzle parts is the value resulting from dividing the ejection volume V of the nozzle parts in the above formula by the number of the nozzle parts that are measurement objects, and is evaluated as the average value of the ejection volume in the ejection when the plurality of nozzle parts are used.

<Modification of Method 3>

When the ejection volume is collectively measured for a plurality of nozzle parts in Method 3, all nozzle parts belonging to the nozzle array along the W-direction illustrated in FIG. 3 can be applied as the plurality of nozzle parts. Further, the nozzle array may be a single array, or may be a plurality of arrays. Furthermore, in the case where the nozzle parts to be arranged at the joint part have been decided, the nozzle parts to be arranged at the joint part may be applied as the plurality of nozzle parts.

<Method 4>

The ejection volume of the liquid can be measured using a micro-syringe, instead of the mass measurement of the liquid in Method 3.

Figure 29:
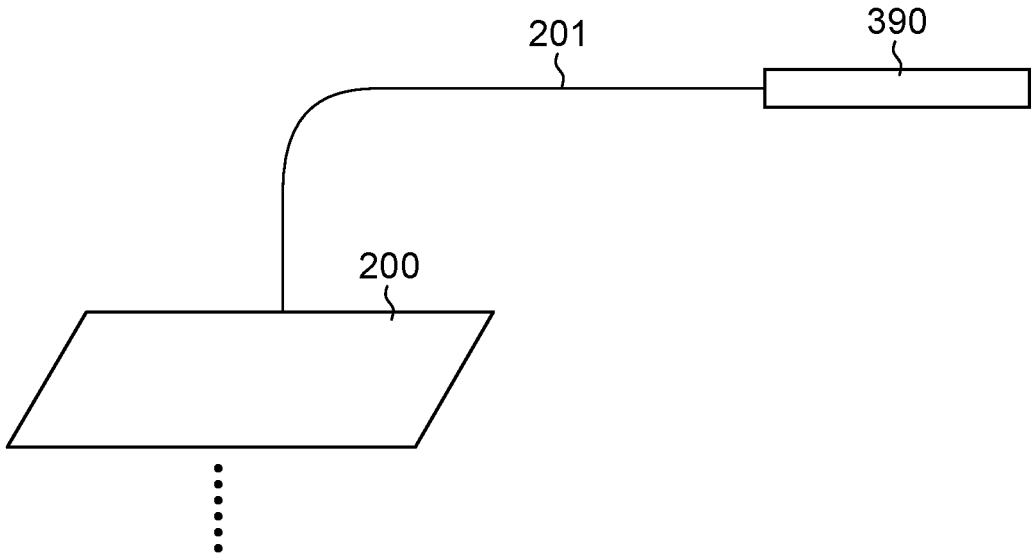
FIG. 29 is an explanatory diagram schematically illustrating the measurement of the ejection volume of liquid with use of a micro-syringe.

FIG. 29 is an explanatory diagram schematically illustrating the measurement of the ejection volume of the liquid with use of the micro-syringe. As illustrated in FIG. 29, a micro-syringe 390 is attached to a liquid supply part 201 of the head module 200, and the movement amount on a scale of the micro-syringe 390 is measured.

The relation of the ejection volume $V_S$ of each nozzle part, the movement amount S on the scale of the micro-syringe, the number $T_S$ of times of the ejection of each nozzle part and the density $D_S$ of the liquid can be expressed as $V_S=S/T_S/D_S$.

<Modification of Method 4>

When the ejection volume is collectively measured for a plurality of nozzle parts in Method 4, all nozzle parts belonging to the nozzle array along the W-direction illustrated in FIG. 3 can be applied as the plurality of nozzle parts. Further, the nozzle array may be a single array, or may be a plurality of arrays. Furthermore, in the case where the nozzle parts to be arranged at the joint part are decided, the nozzle parts to be arranged at the joint part may be applied as the plurality of nozzle parts.

<Method 5>

The ejection volume of each nozzle part can be derived by computation, using the information about the average value of the ejection volumes of all nozzle parts of the head module and the information about the ejection volume distribution of the head module. In the case where the ejection volume distribution of the head module can be approximated by a straight line, the ejection volume of each nozzle part can be derived from a linear function expressing the ejection volume distribution of the head module or the slope of the ejection volume distribution of the head module.

In the flowchart illustrated in FIG. 23, it is possible to employ a mode of including a first ejection volume distribution information acquisition step of acquiring the information about the ejection volume distribution of the first head module in the longitudinal direction of the ink-jet head and a first average value acquisition step of acquiring the information about the average value of the ejection volumes of all ejection elements of the first head module, in which the first representative value $V_{typ1}$ that is derived using the information about the ejection volume distribution of the first head module in the longitudinal direction of the ink-jet head and the information about the average value of the ejection volumes of all ejection elements of the first head module is acquired in the representative value acquisition step S20.

Further, in the flowchart illustrated in FIG. 23, it is possible to employ a mode of including a second ejection volume distribution information acquisition step of acquiring the information about the ejection volume distribution of the second candidate head module in the longitudinal direction of the ink-jet head and a second average value acquisition step of acquiring the information about the average value of the ejection volumes of all ejection elements of the second candidate head module, in which the second representative value $V_{typ2}$ that is derived using the information about the ejection volume distribution of the second candidate head module in the longitudinal direction of the ink-jet head and the information about the average value of the ejection volumes of all ejection elements of the second candidate head module is acquired in the representative value acquisition step S20.

<Condition of Ejection Volume Measurement>

In the measurement of the ejection voltage of each nozzle part, it is preferable to perform the ejection while applying the highest printing duty that can be used in the actual printing. The printing duty corresponds to the liquid ejection duty.

Generally, in the ink-jet head, in the case where the ejection volume to be ejected in a unit of time within the same head module is relatively large, a cross talk occurs, and the ejection volume distribution within the head module changes. In addition, in the image quality for the case where the printing duty is high, the unevenness is visually recognized more easily than in the image quality for the case where the printing duty is low.

Therefore, it is preferable to evaluate the ejection volume for each nozzle part, using the measurement value of the ink ejected by applying the highest printing duty, which is an ejection condition in which a cross talk occurs easily and the unevenness is visually recognized easily.

Here, the high duty, as a guide, may be 80 percent or more of the maximum value of the volume of the ink droplet that can be used in the actual printing. In the case where multiple kinds of ink droplets different in volume are used in the actual printing, the maximum value of the volume of the ink droplet can be evaluated by multiplying the volumes of the respective kinds of ink droplets by the use ratios and adding the resulting values with respect to all kinds of ink droplets that are used.

For example, in the case where two droplet types of 2.0 picoliter and 6.0 picoliter are used at a use ratio of 50 percent, the maximum value of the volume of the ink droplet is calculated to 4.0 picoliter, and therefore, a printing duty by which the volume of the ink droplet is 3.2 picoliter or more and 4.0 picoliter or less may be applied.

Examples of the dot diameter evaluation chart to be formed in the above Method 1 include a configuration in which a high density pattern is formed by applying the highest printing duty, ink droplets having the smallest volume that is used in printing are ejected from the nozzle parts after the formation of the high density pattern and the ink droplets ejected from the nozzle parts are discretely arranged.

[Application Example of System Invention]

It is possible to configure an ink-jet head production system that includes an apparatus corresponding to the steps illustrated in FIG. 23.

Figure 30:
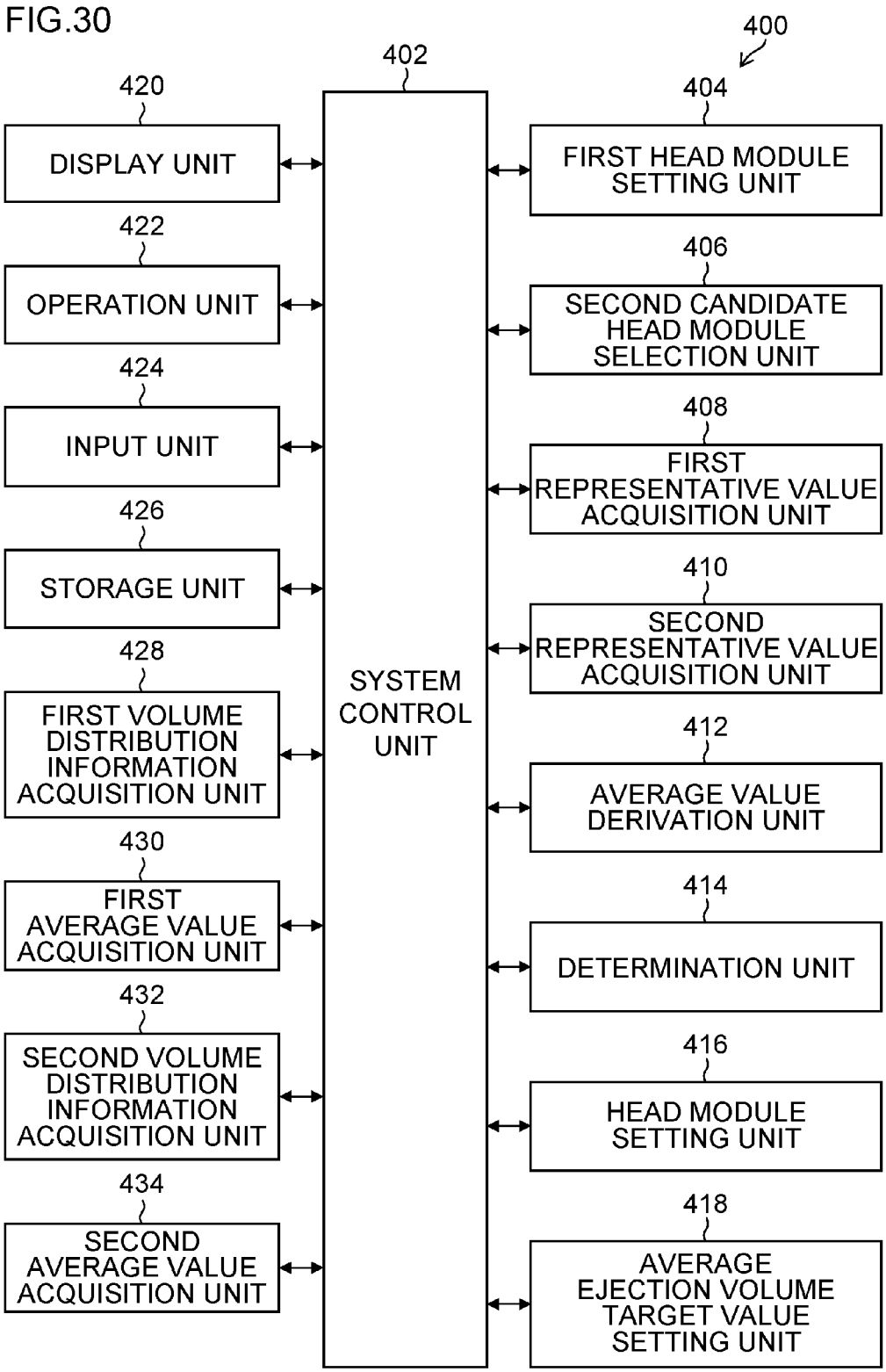
FIG. 30 is a block diagram illustrating a schematic configuration of an ink-jet head production system.

FIG. 30 is a block diagram illustrating a schematic configuration of the ink-jet head production system. The ink-jet head production system in the embodiment is a mode of the liquid ejection head production system.

In an ink-jet head production system 400 illustrated in FIG. 30, a system control unit 402 integrally controls the units of the system.

The ink-jet head production system 400 includes a first head module setting unit 404 that sets the first head module, a second candidate head module selection unit 406 that selects the second candidate head module that is a candidate for the second head module, a first representative value acquisition unit 408 that acquires the first representative value of the first head module, a second representative value acquisition unit 410 that acquires the second representative value of the second candidate head module, an average value derivation unit 412 that derives the average value of the first representative value and the second representative value, a determination unit 414 that determines whether the average value derived by the average value derivation unit 412 is 0.76-fold or more and 1.24-fold or less of the average ejection volume target value, and a head module setting unit 416 that sets, as the second head module, the second candidate head module for which the determination unit 414 determines that the average value derived by the average value derivation unit 412 is 0.76-fold or more and 1.24-fold or less of the average ejection volume target value.

Further, the ink-jet head production system 400 can include devices that actualize the functions and processes of the steps in the ink-jet head production method described above. That is, the ink-jet head production system 400 includes an average ejection volume target value setting unit 418 that sets the average ejection volume target value, a display unit 420 that functions as a device that displays a variety of information, an operation unit 422 such as a keyboard and a mouse, an input unit 424 that functions as an input device for the information acquired from the exterior, and a storage unit 426 in which at least one piece of information of a variety of input information and the information to be used for computation and determination is stored.

Further, the ink-jet head production system 400 includes a first volume distribution information acquisition unit 428 that acquires the first volume distribution information that is the information about the volume distribution of the first head module in the longitudinal direction of the ink-jet head 21, a first average value information acquisition unit 430 that acquires the information about the average value of the ejection volumes of all nozzle parts 281 of the first head module, a second volume distribution information acquisition unit 432 that acquires the second volume distribution information that is the information about the volume distribution of the second candidate head module in the longitudinal direction of the ink-jet head 21, and a second average value information acquisition unit 434 that acquires the information about the average value of the ejection volumes of all nozzle parts 281 of the second head module. Here, each constituent of the ink-jet head production system 400 illustrated in FIG. 30 can be modified, deleted or added, when appropriate.

Furthermore, the above ink-jet head production system can function as a production support system that collectively selects the same number of candidate head modules as the number of the head modules constituting the ink-jet head, reads the representative values of the candidate head modules and supports the optimization of the arrangement of the head modules, using a statistical technique.

[Configuration Example of Apparatus to which Liquid Ejection Head is Applied]

Next, a configuration example of an apparatus to which an ink-jet head according to the embodiment is applied is described. In an ink-jet recording apparatus including multiple ink-jet heads, which is an apparatus including an ink-jet head for each of multiple kinds of ink, it is preferable to be a mode of having an identical configuration for all ink-jet heads.

In the mode of including an ink-jet head for each of multiple kinds of ink, by adopting an identical configuration for all ink-jet heads, the appearance of the color deviation at the central part in the longitudinal direction of the ink-jet head is suppressed.

In the embodiments in the present invention described above, the constituent elements can be modified, added or deleted, when appropriate, in a range without departing from the spirit of the present invention. The present invention is not limited to the embodiments described above, and many modifications can be made by a person having common knowledge in the art, within the technical idea of the present invention.

What is claimed is:

1. A production method for a liquid ejection head having a structure in which a plurality of head modules are arranged along a single direction, each of the plurality of head modules including a plurality of ejection elements, the liquid ejection head production method comprising:

a first head module setting step of setting a first head module;

a second candidate head module selection step of selecting a second candidate head module, the second candidate head module being a candidate for a second head module, the second head module being arranged at a position that is adjacent to the first head module;

a first representative value acquisition step of acquiring a first representative value, the first representative value being a representative value of ejection volumes of ejection elements that are included in the first head module and that are arranged at a joint part between the first head module and the second head module;

a second representative value acquisition step of acquiring a second representative value, the second representative value being a representative value of ejection volumes of ejection elements that are included in the second candidate head module and that are arranged at the joint part;

an average value derivation step of deriving an average value of the first representative value and the second representative value; and a setting step of setting, as the second head module, the second candidate head module by which the average value derived in the average value derivation step is 0.76-fold or more and 1.24-fold or less of an average ejection volume target value, the average ejection volume target value being a previously decided target value of an average ejection volume in a whole of the head module.

2. The liquid ejection head production method according to claim 1, wherein an average value of the ejection volumes of the ejection elements that are included in the first head module and that are arranged at the joint part is acquired as the first representative value, in the first representative value acquisition step, and an average value of the ejection volumes of the ejection elements that are included in the second candidate head module and that are arranged at the joint part is acquired as the second representative value, in the second representative value acquisition step.

3. The liquid ejection head production method according to claim 1, wherein a median value of the ejection volumes of the ejection elements that are included in the first head module and that are arranged at the joint part is acquired as the first representative value, in the first representative value acquisition step, and a median value of the ejection volumes of the ejection elements that are included in the second candidate head module and that are arranged at the joint part is acquired as the second representative value, in the second representative value acquisition step.

4. The liquid ejection head production method according to claim 1, wherein the first representative value that is derived using a measurement value is acquired in the first representative value acquisition step, the measurement value being obtained by measuring a liquid that is ejected by applying a liquid ejection duty, the liquid ejection duty being 80 percent or more of a maximum value of an ejection volume of a droplet that is used in liquid ejection.

5. The liquid ejection head production method according to claim 1, wherein the second representative value that is derived using a measurement value is acquired in the second representative value acquisition step, the measurement value being obtained by measuring a liquid that is ejected by applying a liquid ejection duty, the liquid ejection duty being 80 percent or more of a maximum value of an ejection volume of a droplet that is used in liquid ejection.

6. The liquid ejection head production method according to claim 1, wherein the first representative value that is derived using a measurement result is acquired in the first representative value acquisition step, the measurement result being obtained by measuring a liquid that is ejected by applying an ejection condition, the ejection condition being an ejection condition in which a liquid having a minimum volume is ejected.

7. The liquid ejection head production method according to claim 1, wherein the second representative value that is derived using a measurement result is acquired in the second representative value acquisition step, the measurement result being obtained by measuring a liquid that is ejected by applying an ejection condition, the ejection condition being an ejection condition in which a liquid having a minimum volume is ejected.

8. The liquid ejection head production method according to claim 1, further comprising:

a first ejection volume distribution information acquisition step of acquiring information about ejection volume distribution of the first head module in a longitudinal direction of the liquid ejection head; and a first average value acquisition step of acquiring information about an average value of ejection volumes of all ejection elements of the first head module, wherein the first representative value that is derived using the information about the ejection volume distribution of the first head module in the longitudinal direction of the liquid ejection head acquired in the first ejection volume distribution information acquisition step and the information about the average value of the ejection volumes of all ejection elements of the first head module acquired in the first average value acquisition step is acquired in the first representative value acquisition step.

9. The liquid ejection head production method according to claim 1, further comprising:

a second ejection volume distribution information acquisition step of acquiring information about ejection volume distribution of the second candidate head module in a longitudinal direction of the liquid ejection head; and a second average value acquisition step of acquiring information about an average value of ejection volumes of all ejection elements of the second candidate head module, wherein the second representative value that is derived using the information about the ejection volume distribution of the second candidate head module in the longitudinal direction of the liquid ejection head acquired in the second ejection volume distribution information acquisition step and the information about the average value of the ejection volumes of all ejection elements of the second candidate head module acquired in the second average value acquisition step is acquired in the second representative value acquisition step.

10. The liquid ejection head production method according to claim 1, further comprising an average ejection volume target value setting step of setting the average ejection volume target value.

11. The liquid ejection head production method according to claim 1, wherein a head module in which the average ejection volume in whole of the head module is adjusted to a previously decided value is selected as the second candidate head module, in the second candidate head module selection step.

12. The liquid ejection head production method according to claim 10, wherein a head module in which the average ejection volume in whole of the head module is adjusted to the average ejection volume target value is selected as the second candidate head module, in the second candidate head module selection step.

13. The liquid ejection head production method according to claim 1, further comprising a first candidate head module selection step of selecting a first candidate head module, the first candidate head module being a candidate for the first head module, wherein the first candidate head module is set as the first head module, in the first head module setting step.

14. The liquid ejection head production method according to claim 1, further comprising a second representative value storage step of storing the second representative value, wherein, in a case where the second representative value stored in the second representative value storage step is present, the stored second representative value is read as the first representative value, in the first representative value acquisition step.

15. A production system for a liquid ejection head having a structure in which a plurality of head modules are arranged along a single direction, each of the plurality of head modules including a plurality of ejection elements, the liquid ejection head production system comprising:

a first head module setting unit that sets a first head module;

a second candidate head module selection unit that selects a second candidate head module, the second candidate head module being a candidate for a second head module, the second head module being arranged at a position that is adjacent to the first head module;

a first representative value acquisition unit that acquires a first representative value, the first representative value being a representative value of ejection volumes of ejection elements that are included in the first head module or are included in a first candidate head module and that are arranged at a joint part between the first head module and the second head module, the first candidate head module being a candidate for the first head module;

a second representative value acquisition unit that acquires a second representative value, the second representative value being a representative value of ejection volumes of ejection elements that are included in the second candidate head module and that are arranged at the joint part;

an average value derivation unit that derives an average value of the first representative value and the second representative value; and a second head module setting unit that sets, as the second head module, the second candidate head module by which the average value derived by the average value derivation unit is 0.76-fold or more and 1.24-fold or less of an average ejection volume target value, the average ejection volume target value being a previously decided target value of an average ejection volume in a whole of the head module.

* * * * *